US009664480B2

(12) United States Patent
Faifer

(10) Patent No.: US 9,664,480 B2
(45) Date of Patent: May 30, 2017

(54) HOLSTER BODY AND RETENTION SYSTEM

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 84 days.

(21) Appl. No.: 14/195,541

(22) Filed: Mar. 3, 2014

(65) Prior Publication Data

US 2015/0247701 A1 Sep. 3, 2015

(51) Int. Cl.
*F41C 33/02* (2006.01)
*F41C 33/04* (2006.01)

(52) U.S. Cl.
CPC ..... *F41C 33/0209* (2013.01); *F41C 33/0263* (2013.01); *F41C 33/045* (2013.01)

(58) Field of Classification Search
CPC . F41C 33/00–33/048; A45F 2200/0591; A10S 224/912
USPC ..... 224/192, 243, 244
See application file for complete search history.

(56) References Cited

U.S. PATENT DOCUMENTS

| | | | | |
|---|---|---|---|---|
| 814,599 | A | | 3/1906 | Freyer |
| 837,156 | A | | 11/1906 | Townsend |
| 1,295,831 | A | | 3/1919 | Alderson |
| 2,347,006 | A | | 4/1944 | Tibbetts |
| 2,408,678 | A | | 10/1946 | Paley |
| 2,443,397 | A | | 6/1948 | Myers |
| 2,455,635 | A | | 12/1948 | Witte |
| 2,765,968 | A | | 10/1956 | Gaylord |
| 3,008,617 | A | | 11/1961 | Villwock |
| 3,128,926 | A | | 4/1964 | Stella |
| 3,707,250 | A | | 12/1972 | Esposito |
| 3,731,858 | A | | 5/1973 | Baker |
| 3,777,952 | A | | 12/1973 | Theodore |
| 3,910,469 | A | * | 10/1975 | Baldocchi ..... 224/198 |
| 3,952,930 | A | | 4/1976 | Baldocchi |
| 3,977,583 | A | | 8/1976 | Bianchi et al. |
| 4,035,902 | A | | 7/1977 | Bianchi et al. |
| 4,044,929 | A | | 8/1977 | Caruso |
| 4,062,481 | A | | 12/1977 | Clark |
| 4,065,039 | A | | 12/1977 | Bianchi et al. |
| 4,084,734 | A | | 4/1978 | Bianchi et al. |
| 4,101,060 | A | | 7/1978 | Bianchi et al. |
| 4,143,798 | A | | 3/1979 | Perkins |
| 4,205,768 | A | | 6/1980 | Hill et al. |
| 4,218,000 | A | | 8/1980 | Mixson |
| 4,258,871 | A | | 3/1981 | McMahon |
| 4,270,680 | A | | 6/1981 | Bianchi |
| 4,277,007 | A | | 7/1981 | Bianchi et al. |
| 4,286,741 | A | | 9/1981 | Rogers |
| 4,494,328 | A | | 1/1985 | Stevens |
| 4,542,841 | A | | 9/1985 | Bianchi et al. |
| 4,577,787 | A | | 3/1986 | Hersey |
| 4,662,552 | A | | 5/1987 | Uyehara |
| 4,713,889 | A | | 12/1987 | Santiago |
| 4,741,465 | A | | 5/1988 | Johnson |

(Continued)

*Primary Examiner* — Justin Larson
*Assistant Examiner* — Phillip Schmidt
(74) *Attorney, Agent, or Firm* — Law Office of Arthur M. Antonelli, PLLC

(57) ABSTRACT

A holster body for a gun which may be configurable for left or right dominant hand use and a retention system which may be used with the holster body to form a plurality of retention holster configurations including, without limitation, a Level I retention holster configuration and a Level II retention holster configuration.

25 Claims, 16 Drawing Sheets

(56) References Cited

U.S. PATENT DOCUMENTS

| | | | | |
|---|---|---|---|---|
| 4,886,197 | A | 12/1989 | Bowles et al. | |
| 4,925,075 | A | 5/1990 | Rogers | |
| 4,953,769 | A | 9/1990 | Parsons et al. | |
| D311,277 | S | 10/1990 | Cupp | |
| 4,966,321 | A | 10/1990 | Outlaw | |
| 5,018,653 | A | 5/1991 | Shoemaker | |
| 5,048,682 | A | 9/1991 | Taylor | |
| 5,054,670 | A | 10/1991 | Gallagher | |
| 5,100,036 | A | 3/1992 | Rogers et al. | |
| D327,367 | S | 6/1992 | Carrow et al. | |
| D331,497 | S | 12/1992 | Dixon | |
| 5,174,482 | A | 12/1992 | Rogers et al. | |
| 5,209,383 | A | 5/1993 | Theodore | |
| 5,251,798 | A | 10/1993 | Theodore | |
| 5,251,799 | A | 10/1993 | Theodore | |
| 5,265,781 | A | 11/1993 | Nichols | |
| 5,275,317 | A | 1/1994 | Rogers et al. | |
| 5,282,559 | A | 2/1994 | Wisser et al. | |
| 5,419,472 | A | 5/1995 | Hellweg et al. | |
| 5,421,497 | A | 6/1995 | Gilmore | |
| 5,484,093 | A | 1/1996 | Hellweg et al. | |
| 5,544,794 | A | 8/1996 | Nichols | |
| D373,242 | S | 9/1996 | Beletsky | |
| 5,551,610 | A | 9/1996 | Clifton, Jr. | |
| 5,570,830 | A | 11/1996 | Nichols | |
| 5,632,426 | A | 5/1997 | Beletsky et al. | |
| D392,458 | S | 3/1998 | Batts | |
| 5,865,357 | A | 2/1999 | Goodwin | |
| 5,875,944 | A | 3/1999 | Beletsky | |
| 5,918,784 | A | 7/1999 | Serpa | |
| 5,996,865 | A | 12/1999 | Bissey | |
| 6,154,997 | A | 12/2000 | Aluotto et al. | |
| 6,161,741 | A * | 12/2000 | French | 224/198 |
| 6,202,908 | B1 | 3/2001 | Groover | |
| 6,276,581 | B1 * | 8/2001 | Glock | 224/244 |
| 6,398,089 | B1 | 6/2002 | Har-Shen | |
| 6,438,888 | B1 | 8/2002 | Lin | |
| 6,588,635 | B2 | 7/2003 | Vor Keller et al. | |
| 6,763,984 | B2 | 7/2004 | Gallagher | |
| 6,769,581 | B2 | 8/2004 | Rodgers et al. | |
| 6,769,582 | B1 * | 8/2004 | Beletsky et al. | 224/244 |
| D501,991 | S | 2/2005 | Cook et al. | |
| D507,104 | S | 7/2005 | Gregory et al. | |
| D508,318 | S | 8/2005 | Gregory et al. | |
| 6,948,644 | B1 | 9/2005 | Beletsky | |
| D512,561 | S | 12/2005 | Cook et al. | |
| 7,028,426 | B1 | 4/2006 | Viani | |
| 7,032,342 | B2 | 4/2006 | Pikielny | |
| 7,117,625 | B2 | 10/2006 | Pikielny | |
| 7,131,228 | B2 | 11/2006 | Hochstrate | |
| D537,624 | S | 3/2007 | Har | |
| 7,191,556 | B2 | 3/2007 | Pikielny | |
| 7,216,450 | B2 | 5/2007 | Pikielny | |
| 7,258,259 | B1 | 8/2007 | Owens | |
| D567,501 | S | 4/2008 | Zusman | |
| D568,043 | S | 5/2008 | Zusman | |
| D574,147 | S | 8/2008 | Zusman | |
| 7,434,712 | B2 | 10/2008 | Cook et al. | |
| D594,649 | S | 6/2009 | Zusman | |
| 7,562,797 | B2 | 7/2009 | Senn et al. | |
| D601,339 | S | 10/2009 | Zusman | |
| D603,159 | S | 11/2009 | Zusman | |
| D603,160 | S | 11/2009 | Zusman | |
| 7,735,255 | B1 | 6/2010 | Kincaid | |
| 7,814,698 | B2 | 10/2010 | Fluhr | |
| 7,816,888 | B2 | 10/2010 | Rejman | |
| D641,548 | S | 7/2011 | Zusman | |
| 8,235,263 | B1 | 8/2012 | Yeates | |
| 8,631,981 | B2 | 1/2014 | Zusman | |
| 2005/0205621 | A1 | 9/2005 | Shults | |
| 2005/0223614 | A1 | 10/2005 | Pikielny | |
| 2005/0268518 | A1 | 12/2005 | Pikielny | |
| 2005/0268519 | A1 | 12/2005 | Pikielny | |
| 2006/0130386 | A1 | 6/2006 | Pikielny | |
| 2006/0156609 | A1 | 7/2006 | Kim | |
| 2006/0226185 | A1 * | 10/2006 | Har-Shen | 224/244 |
| 2006/0236583 | A1 | 10/2006 | Pikielny | |
| 2007/0017140 | A1 | 1/2007 | Pikielny | |
| 2007/0084101 | A1 | 4/2007 | Pikielny | |
| 2007/0175935 | A1 | 8/2007 | Clifton | |
| 2007/0266611 | A1 | 11/2007 | Stover | |
| 2009/0321480 | A1 * | 12/2009 | Kincaid et al. | 224/243 |
| 2013/0306691 | A1 * | 11/2013 | Baumann et al. | 224/244 |

* cited by examiner

HOLSTER BODY AND RETENTION SYSTEM

FIELD OF THE INVENTION

The present invention generally relates to a retention holster for a gun. More particularly, this invention relates to a holster body and retention system for a handgun. This invention also relates to a holster body that may be assembled with modular type components into a retention holster for left or right dominant hand use, as well as a plurality of retention holster configurations including, without limitation, a Level I retention holster configuration and a Level II retention holster configuration.

BACKGROUND

Holsters are generally designed to offer protection to a gun, secure its retention, and provide ready access to it. A Level I holster has a single retention device such as a thumb break. A Level II holster has two devices, or motions, which are required to draw the gun. On a Level III holster, the user has to perform three steps to draw the gun. The need for ready access to a holstered gun may be at odds with the need for security and protection. Accordingly, holster performance may be related to the fit of the holster with the gun and the user. Thus, a need exists for retention holsters which provide a proper fit with a gun and the user of the holster.

SUMMARY

Hence, the present invention is directed to a holster body and retention system. In one aspect, the present invention relates to a holster for a gun which comprises a holster body having a longitudinal axis, a vertical axis, and a lateral axis. Additionally, the holster body may comprise a proximal end portion and a distal end portion spaced from the proximal end portion along the longitudinal axis, a port sidewall and a starboard sidewall spaced from the port sidewall along the lateral axis, an upper sidewall and a lower sidewall spaced from the upper sidewall along the vertical axis.

In another aspect, the holster body may comprise a receptacle for a gun having a trigger guard, the receptacle being situated between the port sidewall, the starboard sidewall, the upper sidewall and the lower sidewall. The receptacle may comprise a rim about the proximal end portion for accessing the receptacle, a barrel receiving portion adjacent the upper sidewall, a trigger guard receiving portion adjacent the lower sidewall, and a first catch opening adjacent the trigger guard portion. The first catch opening may extend through the starboard sidewall. A first catch attachment site may be situated near the first catch opening, and a first finger button panel attachment site may be spaced from the first catch attachment site.

In another aspect, the holster may further comprise a first catch connected to the first catch attachment site. The first catch may comprise a first blocking member, a first lever end, and a first holster body attachment site disposed between the first blocking member and the first lever end such that the first holster body attachment site is attached to the first catch attachment site to form a first catch pivot axis. The holster may comprise a fastener, and the fastener may connect the first holster body attachment site to the first catch attachment site. The fastener may be a rigid pin.

The holster may comprise a first finger button panel, which is connected to the first finger button panel attachment site. The first finger button panel may comprise a tip portion which may comprise a first plate, a base portion, and a first side pocket. The first side pocket may be situated between the tip portion and the base portion such that the first lever end of the first catch is positioned in the first side pocket. The first finger button panel may comprise a first holster body connection site located near the base portion such that the first holster body connection site may be secured to the first finger button panel attachment site to form a first finger button panel pivot axis. The first catch pivot axis may be substantially parallel to the longitudinal axis of the holster body and the first finger button pivot axis may be substantially parallel to the vertical axis of the holster body.

The first finger button attachment site may comprise a first retention track segment adjacent the starboard sidewall of the holster body and the first plate of the first finger button panel may be disposed in the first retention track segment. The tip portion further may comprise a second plate, the first finger button attachment site may comprise a second retention track segment facing the first retention track segment, and the second plate may be disposed in the second retention track segment.

In another aspect, the holster body may be symmetrical about a central plane defined by the longitudinal axis and the vertical axis of the holster body.

In another aspect, the first lever end may be interposed between the first finger button panel and the holster body. Additionally, the first side pocket may fix the first lever end with respect to the holster body.

In another aspect, the holster may comprise a first configuration and a second configuration such that in the first configuration the first blocking member is positioned inside the trigger guard receiving portion of the receptacle to obstruct passage of a holstered gun's trigger guard, and in the second configuration the first catch flexes outwardly from the trigger guard receiving portion of the receptacle to allow passage of a holstered gun's trigger guard in response to application of a first preset level of force by a holstered gun's trigger guard against the first blocking member. Additionally, the holster may comprise an accessory connector insert which comprises a core, a side flange, and a second side pocket intersecting the side flange. The holster body further may comprise a second catch opening adjacent the trigger guard portion, the second catch opening may extend through the port sidewall. The holster body may comprise a second catch attachment site situated near the second catch opening. Also, the holster body may comprise a second finger button panel attachment site spaced from the second catch attachment site. The side flange may interlock with the second finger button panel attachment site to secure the holster body to the accessory connector insert.

In another aspect, the holster further may comprise a second catch connected to the second catch attachment site. The second catch may comprise a second blocking member, a second lever end, and a second holster body attachment site disposed between the second blocking member and the second lever end. The second holster body attachment site may be attached to the second catch attachment site to form a second catch pivot axis. Also, the holster may include a second fastener, the second fastener connecting the second holster body attachment site to the second catch attachment site. The second lever end may be interposed between the accessory connector insert and the holster body, and the second side pocket may fix the second lever end to the holster body.

In another aspect, the holster may comprise a third configuration and a fourth configuration such that in the third configuration the second blocking member is positioned inside the trigger guard receiving portion of the receptacle to obstruct passage of a holstered gun's trigger guard, and in the third configuration the second catch flexes outwardly from the trigger guard receiving portion of the receptacle to allow passage of a holstered gun's trigger guard in response to application of a second preset level of force by a holstered gun's trigger guard against the second blocking member. The second preset level of force may be approximately equal to the first preset level of force.

In another aspect, the accessory connector insert may be fixedly connected to a paddle.

In another aspect, the holster may comprise a fifth configuration and a sixth configuration such that in the fifth configuration the first blocking member is positioned inside the trigger guard receiving portion of the receptacle to obstruct passage of a holstered gun's trigger guard, and in the sixth configuration the first catch is pivoted outwardly from the trigger guard receiving portion of the receptacle to allow passage of a holstered gun's trigger guard in response to application of a third preset level of force by the finger button panel against the first lever end. The finger button panel may be spaced from the holster body in the fifth configuration and the finger button panel may contact the holster body in the sixth configuration.

In another aspect, the holster may comprise a first resilient member positioned between the first catch and the holster body, and a second resilient member positioned between the finger button panel and the holster body. The first and second resilient members may bias the holster into the fifth configuration. Additionally, the holster may comprise an accessory connector insert which comprises a core, a side flange, and a second side pocket intersecting the side flange. The holster body further may comprise a second catch opening adjacent the trigger guard portion. The second catch opening may extend through the port sidewall. The holster body further may comprise a second catch attachment site situated near the second catch opening, as well as a second finger button panel attachment site spaced from the second catch attachment site. The side flange may interlock with the second finger button panel attachment site to secure the holster body to the accessory connector insert.

In another aspect, the holster may comprise a second catch connected to the second catch attachment site. The second catch may comprise a second blocking member, a second lever end, and a second holster body attachment site disposed between the second blocking member and the second lever end such that the second holster body attachment site is attached to the second catch attachment site to form a second catch pivot axis. The holster further may comprise a second fastener, the second fastener connecting the second holster body attachment site to the second catch attachment site. The second lever end may be interposed between the accessory connector insert and the holster body. Also, the second side pocket may fix the second lever end to the holster body.

In another aspect, the holster further may comprise a seventh configuration and an eighth configuration such that in the seventh configuration the first and second blocking members are positioned inside the trigger guard receiving portion of the receptacle to obstruct passage of a holstered gun's trigger guard, and in the eighth configuration the first catch is pivoted outwardly from the trigger guard receiving portion of the receptacle to allow passage of a holstered gun's trigger guard in response to application of a fourth preset level of force by the finger button panel against the first lever end and the second catch flexes outwardly from the trigger guard receiving portion of the receptacle to allow passage of a holstered gun's trigger guard in response to application of a fifth preset level of force by a holstered gun's trigger guard against the second blocking member. The fourth preset level of force may be approximately equal to the third preset level of force and the fifth preset level of force may be approximately equal to the second preset level of force.

DESCRIPTION OF THE DRAWINGS

In the accompanying drawings, which form a part of the specification and are to be read in conjunction therewith and in which like reference numerals (or designations) are used to indicate like parts in the various views.

DESCRIPTION

Figure 1:
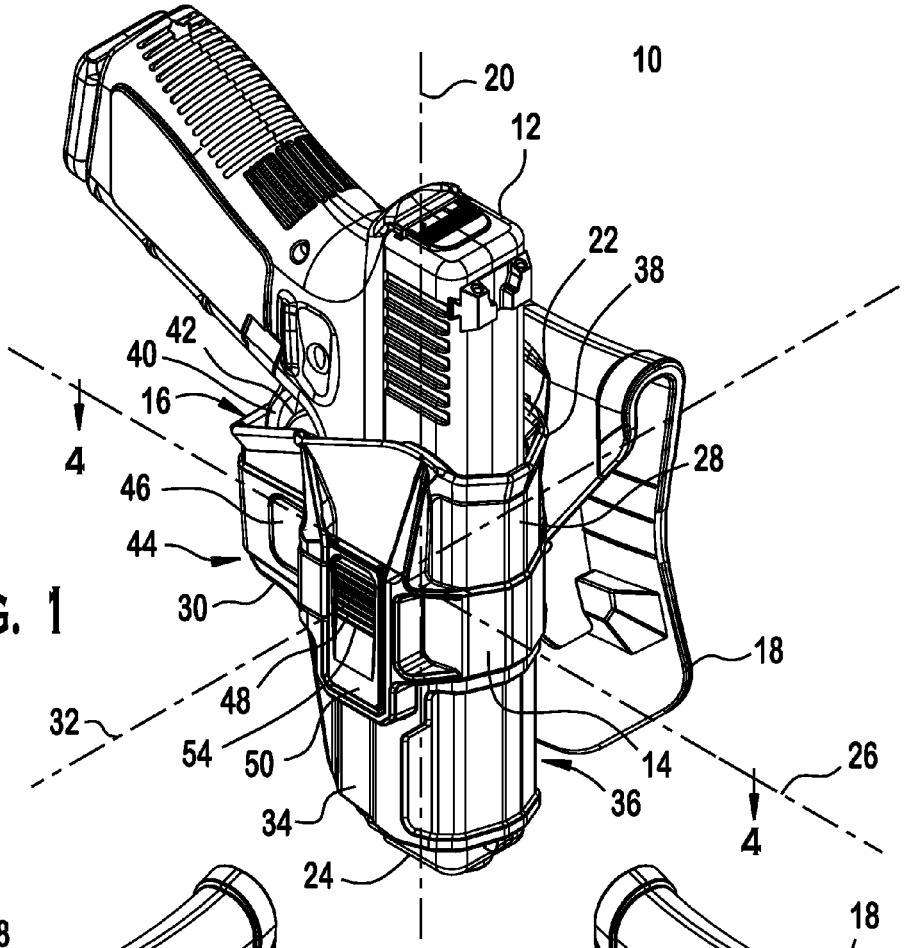
FIG. 1 is a perspective view of an exemplary embodiment of a holster for a gun in accordance with the present invention, along with a pistol disposed in the holster.

FIG. 1 shows an exemplary embodiment of a holster 10 for a gun 12. The holster 10 is shown in a configuration for use with a user's dominant right hand. The holster includes a holster body 14 which defines an interior space (or receptacle) 16 for holding a gun, as well as a paddle 18 for positioning the holster 10 with respect to a user's torso. The holster 10 may be adapted for use with full size, compact or pocket handguns.

The holster body 14 may have a longitudinal axis 20, which may be aligned with the barrel of the handgun. The holster body 14 further may include a proximal end 22 and a distal end 24 spaced from the proximal end along the longitudinal axis. Additionally, the holster body 14 may have a vertical axis 26 which is situated perpendicular to the longitudinal axis 20. The holster body 14 further may include an upper side 28 and a lower side 30 spaced from the upper side along the vertical axis. Also, the holster body 14 may have a lateral axis 32 that is situated perpendicular to the longitudinal axis and the vertical axis. The holster body 14 may have a starboard side 34 and a port side 36.

A gun 12 may be inserted into the receptacle 16 at the proximal end 22 of the holster body 14. The proximal end 22 of the holster body 14 may include a rim 38 which defines a circumference of the proximal opening to the receptacle 16. The rim 38 may flare outwardly so as to facilitate insertion of the gun. The gun 12 may be pushed into the receptacle 16 until secure. In one embodiment, the distal end 24 of the holster body 14 may be open such that the front end of a fully holstered gun may extend through the holster body. In another embodiment, the distal end 24 of the holster 10 may be closed such that the front end of the fully holstered gun may be contained within the distal end 24 of the holster body.

The holster body 14 may shroud the trigger guard 40 of the gun such that the trigger may be disposed within the receptacle 16. The portion of the holster body which surrounds the trigger guard 40 may include a retention system 44 that locks a fully seated gun into the holster. The retention system 44 may include an active trigger guard locking member (or active catch) 46 on the starboard 34 side of the holster body 14. The active catch 46 and the holster body 14 may cooperate to fix the fully seated gun 12 in the holster. For example, the active catch 46 may interlock with the trigger guard 40 to fix the gun in the holster body 14.

As described below in connection with FIGS. 4-7, the active catch 46 may be withdrawn from the interior of the trigger guard 40 by pressing a finger button 48 on a spring loaded panel 50. The panel 50 may be aligned with the longitudinal axis of the holster body 14. Also, the panel 50 may be located in a central portion of the holster body. The finger button 48 may be located in a recessed portion of the panel 50, which may provide a tactile locating mechanism for the finger button. The finger button further may include another tactile locating mechanism. For example, the finger button 48 may include one or more textured features (e.g., a series of parallel ribs) 54 that may complement or enhance the primary tactile locating mechanism.

To promote a close fit between the gun 12 and the holster body 14, the holster body receptacle 16 may be configured and dimensioned to slidably receive a specific type of handgun. For example, the gun may be a Glock 17, and the holster body may be configured and dimensioned to slidably receive and securely hold a portion of that specific weapon. Generally, the holster body 14 and receptacle 16 may be configured and dimensioned to receive other suitable handgun models. For example, without limitation, the holster body 14 and receptacle 16 may be specifically configured for a Glock 23, a Colt M1911, a Smith & Wesson M&P45, a Smith & Wesson Model 686, a SIG Sauer P226, or a Springfield Armory XD 45 handgun.

Figure 2A:
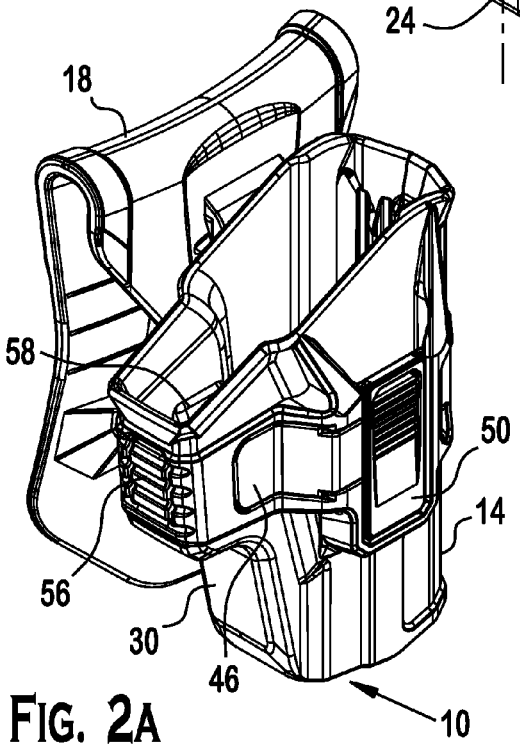
FIG. 2A is a perspective view of the holster of FIG. 1, which is configured for use with a user's right hand.
Figure 10:
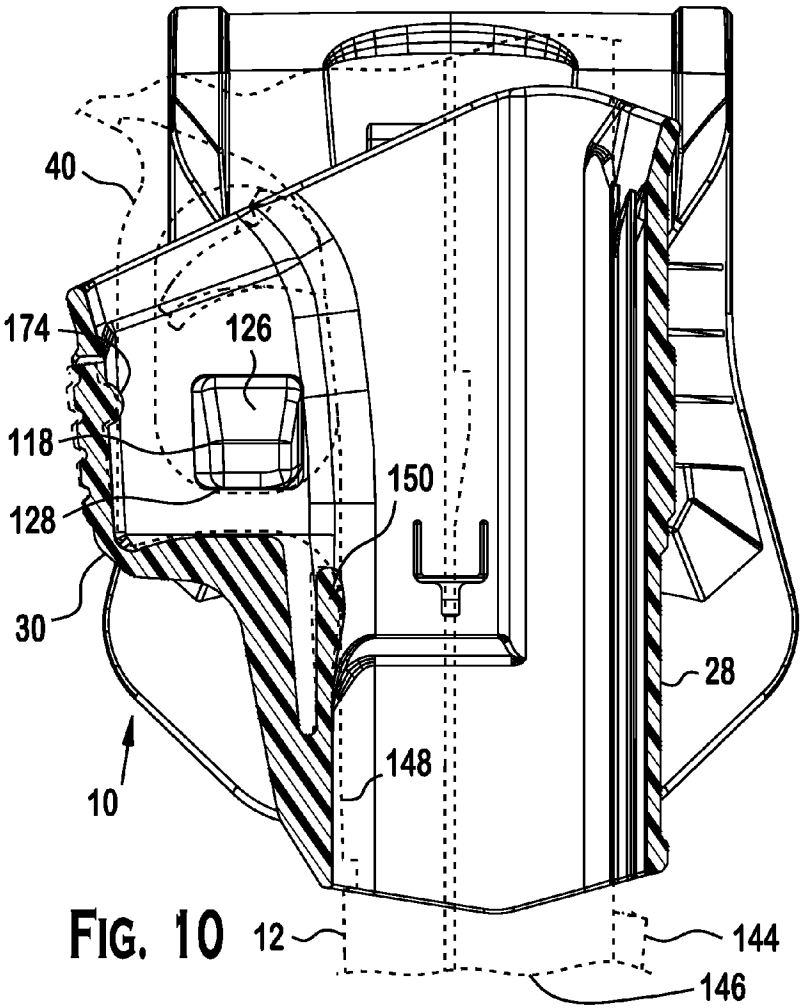
FIG. 10 is a cross-sectional view of the interior, port side of the holster of FIG. 2A, along line 10-10, where the holster is in a locked configuration.
Figure 9:
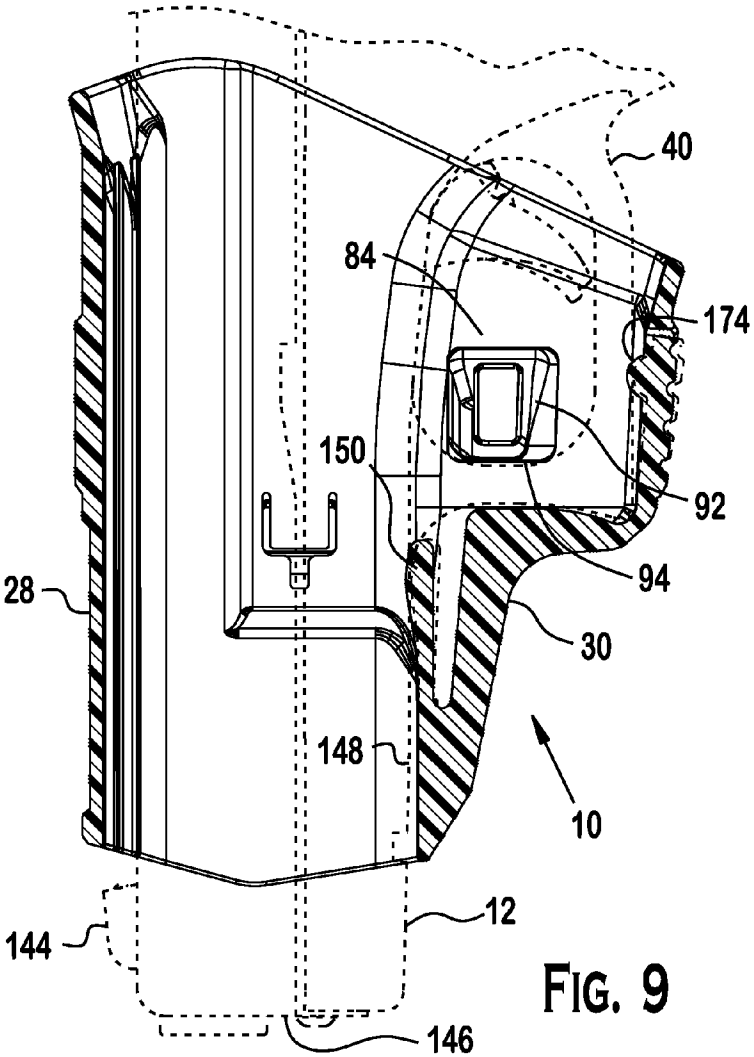
FIG. 9 is a cross-sectional view of the interior, starboard side of the holster of FIG. 2A, along line 9-9, where the holster is in a locked configuration.
Figure 11:
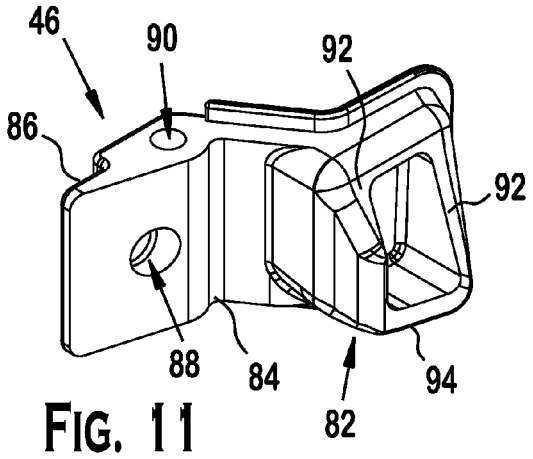
FIG. 11 is a perspective view of an exemplary embodiment of an active catch of FIG. 2A.
Figure 12:
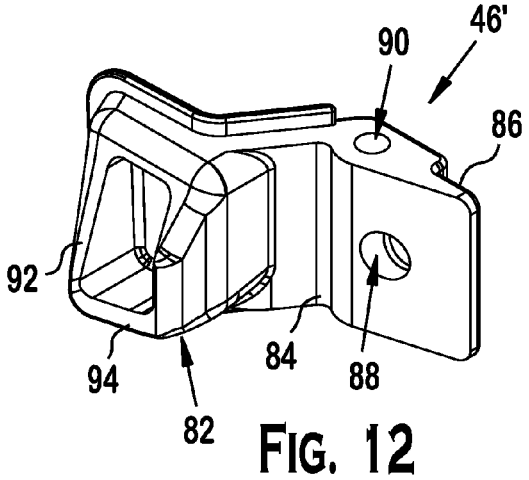
FIG. 12 is a perspective view of an exemplary embodiment of an active catch of FIG. 2B.
Figure 13:
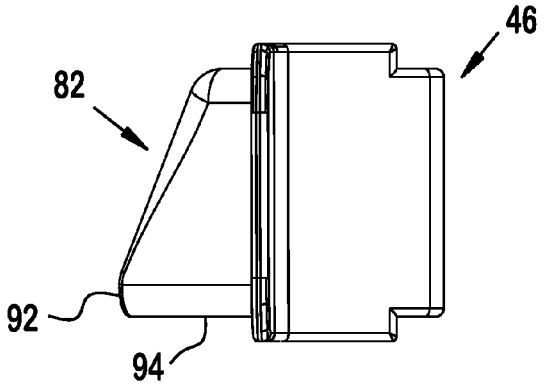
FIG. 13 is an end view of the active catch of FIG. 11.
Figure 14:
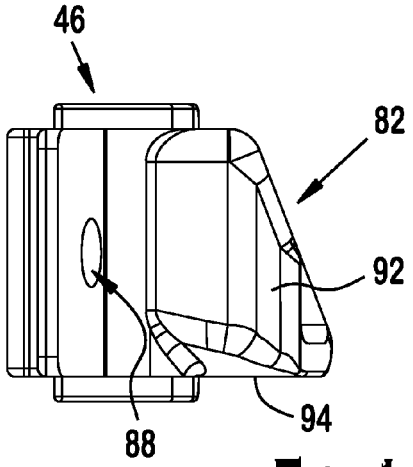
FIG. 14 is an opposite end view of the active catch of FIG. 11.
Figure 15:
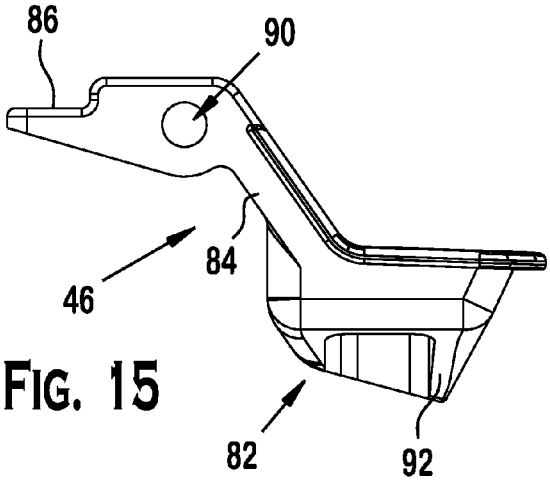
FIG. 15 is a side view of the active catch of FIG. 11.
Figure 16:
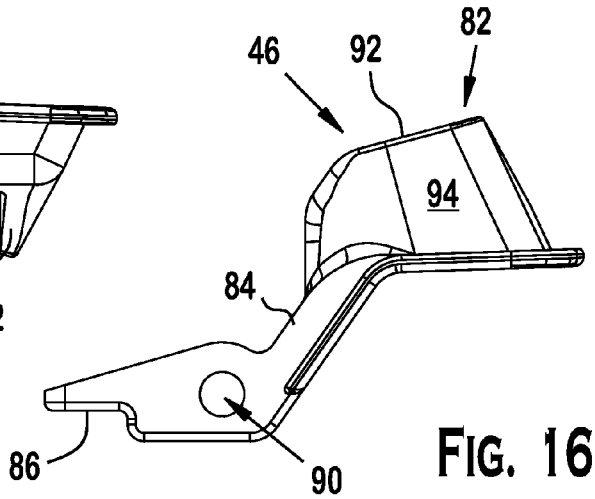
FIG. 16 is an opposite side view of the active catch of FIG. 11.
Figure 17:
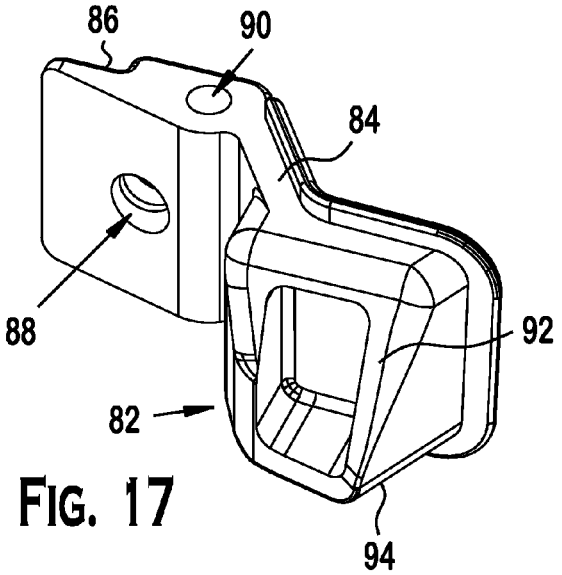
FIG. 17 is another perspective view of the active catch of FIG. 11.

FIG. 2A shows the holster of FIG. 1 without the handgun. In addition to the features described above in connection with FIG. 1, the holster body 14 may further include a resilient tongue (or minor cantilever) 56 on the lower side 30 of the holster body 14. The resilient tongue 56 may help secure a gun in the receptacle 16 by pushing against the bottom of the trigger guard of a holstered gun. The resilient tongue 56 may include a friction reducing structure 174 which is configured to bear against the trigger guard 40 while reducing friction forces generated between the resilient tongue 56 and trigger guard 40 when the holster is being inserted into or drawn from the holster body. In FIG. 9 and FIG. 10, the resilient tongue may include a single friction reducing structure. The friction reducing structure 174 may be a hemispherical projection, but other suitable shapes may be used. Additionally, the holster body 14 may include a trigger guard blocking member (e.g., a passive catch) 58 on the port side 36. The passive catch 58 may be situated opposite the active catch 46.

Figure 2B:
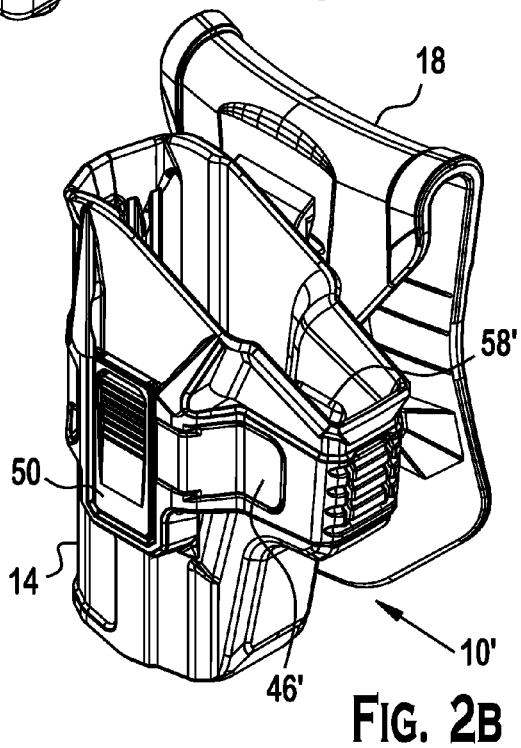
FIG. 2B is a perspective view of another embodiment of the holster of FIG. 1, which is configured for use with a user's left hand.

FIG. 2B shows another embodiment 10' of the holster of FIG. 1, which is configured for use by a user having a dominant left-hand. The paddle 18' of FIG. 2B may be the same paddle 18 as shown in FIG. 2A. The holster body 14' of FIG. 2B may be same holster body 14 as shown in FIG. 2A. Additionally, the spring loaded panel 50' of FIG. 2B may be the same as shown in FIG. 2A. By contrast, the active catch 46' of FIG. 2B and the passive catch 58' of FIG. 2B may be similar but not identical to the active catch 46 and the passive catch 58 of FIG. 2A.

Figure 3A:
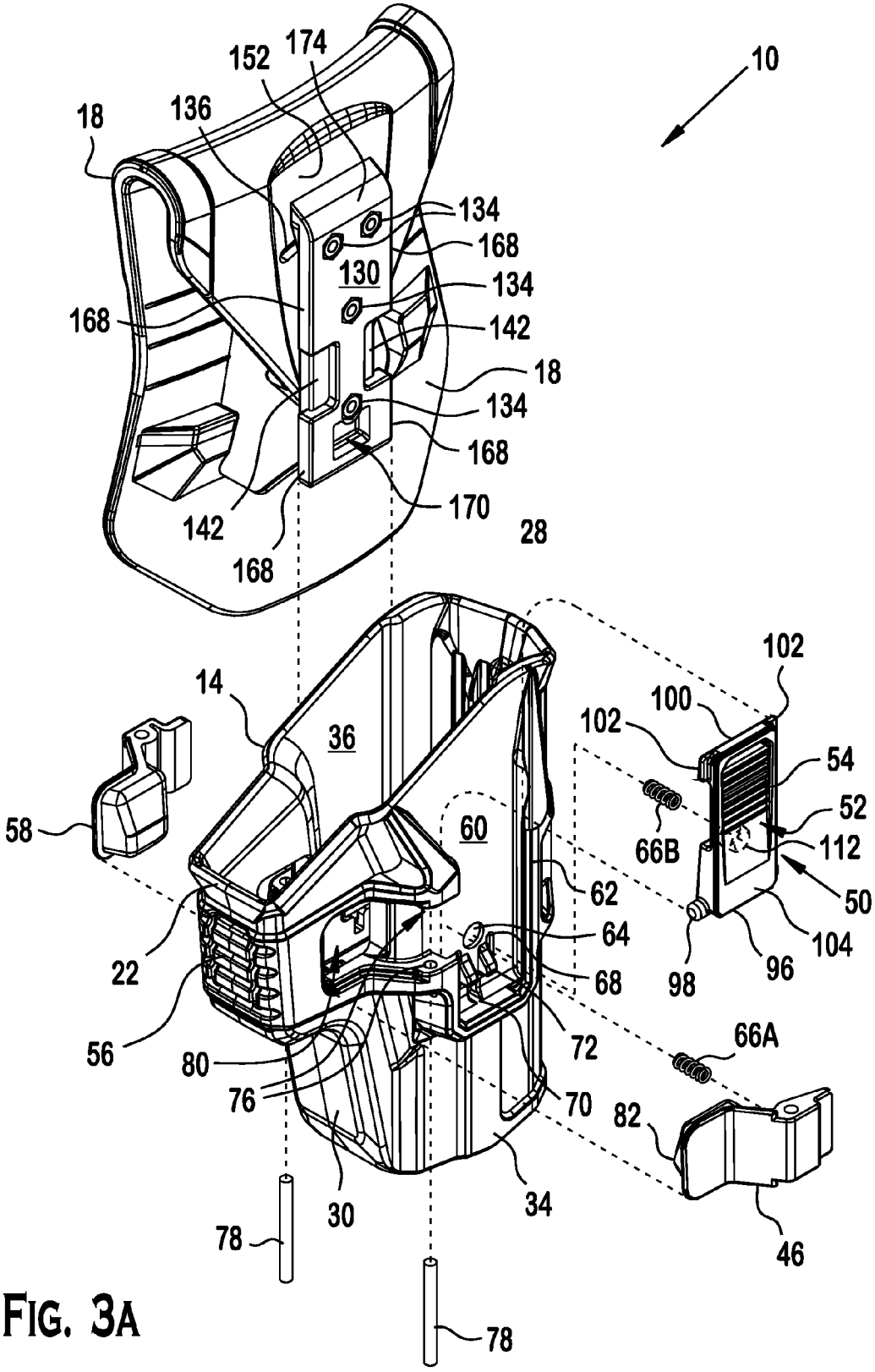
FIG. 3A is an exploded view of the holster of FIG. 2A.
Figure 8:
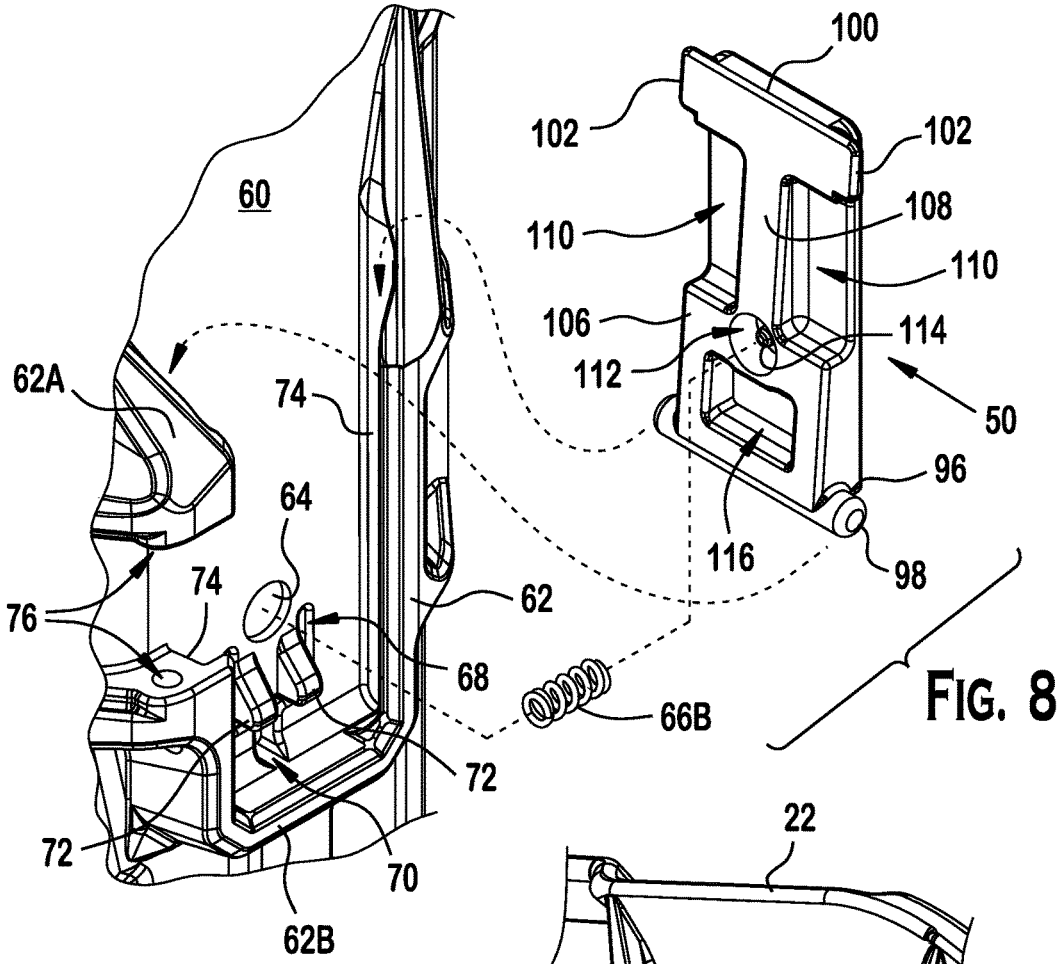
FIG. 8 is an exploded view of the finger button assembly of FIG. 2A.
Figure 8A:
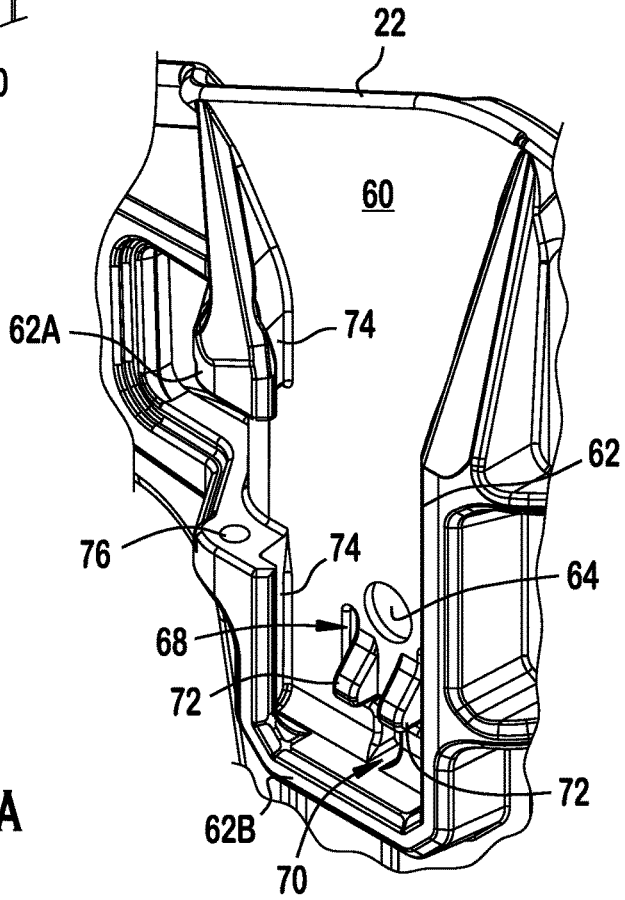
FIG. 8A is perspective view of the recessed plane, ridge wall and retention track of FIG. 8.

FIG. 3A shows an exploded view of the holster 10 of FIG. 2A. As described above, the holster 10 may include a holster body 14 and a paddle 18. The holster body 14 may include an upper sidewall 28, a lower sidewall 30, a starboard sidewall 34 and a port sidewall 36. The starboard sidewall may include a recessed plane 60 and one or more peripheral ridges 62. As shown in FIG. 8 and FIG. 8A, the peripheral ridges 62 may be discontinuous and comprise more than one segment. For example, the peripheral ridge may include one segment 62A adjacent the proximal end of the holster body and another segment 62B located between the one segment and the distal end of the holster body.

Additionally, the recessed plane 60 may include a shallow recess 64 that is configured and dimensioned to receive a compression spring 66. Moreover, adjacent the shallow recess 64, the recessed plane may include a U-shaped slit 68, which extends from the exterior surface of the starboard side of the housing to the interior surface of the starboard side housing. Preferably, the housing wall within the area of the U-shaped 68 slit may be resilient such that the area may be displaced in the direction of the lateral axis. The U-shaped slit further may intersect an I-shaped slit 70 on the recessed plane that extends from a base of the peripheral ridge.

Figure 6:
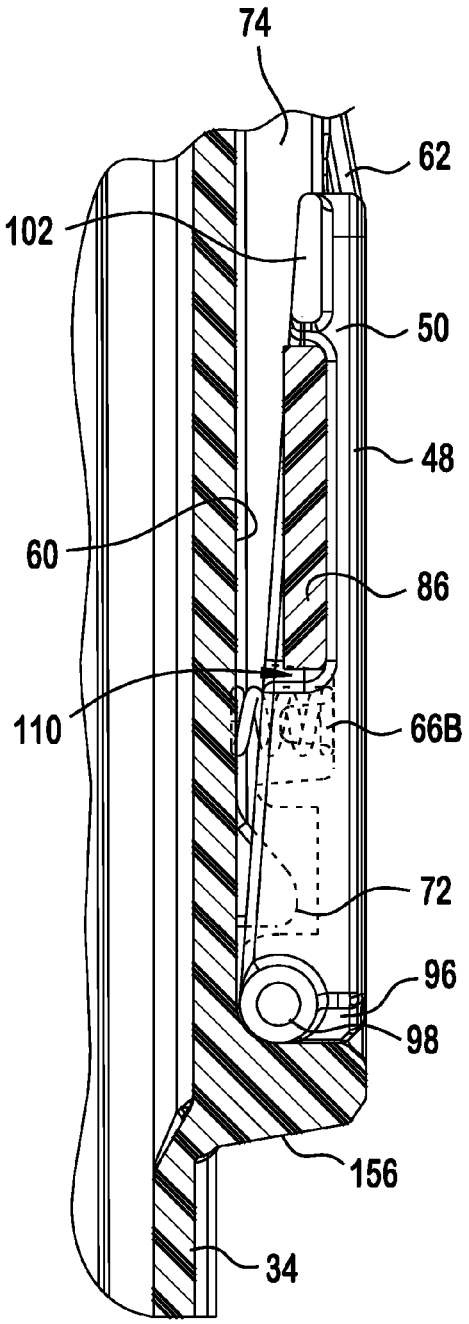
FIG. 6 is a partial cross-sectional view of the holster of FIG. 4, along line 6-6, where the finger button is in a raised position and the active catch is in the locked position.
Figure 7:
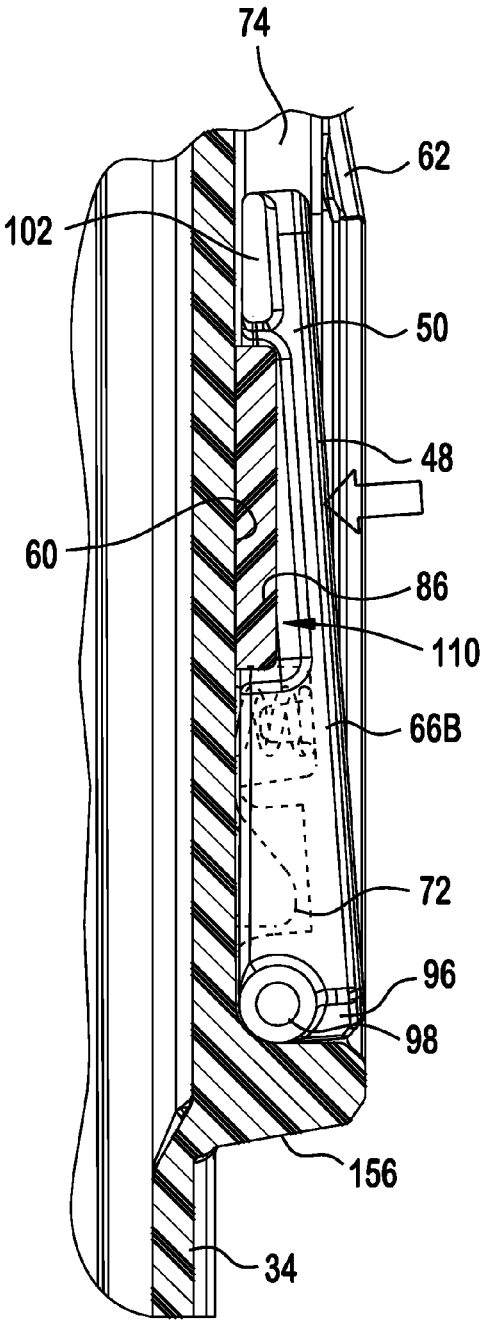
FIG. 7 is a partial cross-sectional view of the holster of FIG. 5, along line 7-7, where the finger button is in a lowered position and the active catch is in the released position.

One or more locking projections 72 may be disposed on the recessed plane 60. For example, a pair of locking projections 72 may be positioned adjacent the shallow recess 64. Each locking projection may include a low end which tapers to the recessed plane 60 and a high end which extends above the recessed plane 60. Referring to FIG. 6 and FIG. 7, the high end of the locking projection (e.g., a ramp) 72 may terminate at an elevation which is less than the elevation of adjacent portions of the peripheral ridge 62. The high end of the locking projection 72 may be situated near the inner leg of the U-shaped groove 68.

As shown in FIG. 8 and FIG. 8A, the peripheral ridge(s) 62 may include a retention track 74.

The track 74 may widen in a gradual taper toward the proximal end of the holster 22, which may provide access to the track for the panel and other component parts (e.g., the fixed panel or the adaptor insert), which may be used with the holster. Additionally, the peripheral ridge segments 62 may include a pin hole 76 for receiving a rigid shaft (FIG. 3A) 78. The pin hole 76 may be a blind hole or a through hole. The pin holes 76 may be used to fix the active catch 46 (FIG. 3A), the passive catch 58 (FIG. 3A), or other components to the housing.

In FIG. 3A, one pin hole is disposed in the one segment adjacent to the proximal end of the holster body and another pin hole is disposed in the other segment located between the one segment and the distal end of the holster body. The one pin hole may be a blind hole and the other pin hole may be a through hole. The pinholes may be aligned. The holster body may further include a catch opening 80 which extends from the exterior surface of the starboard side 34 of the holster body 14 to the interior surface of the starboard side 34 of the holster body 14. The catch opening 80 may be situated adjacent to the recessed plane 60 near the lower side 30 and proximal end 22 of the holster body 14.

Referring to FIGS. 11-18, the active catch 46 may include a locking member 82 on one end of a lever arm 84, a stepped seat 86 at the opposite end of the lever arm 84, a hollow 86 under the stepped seat 84, and a cross-bore 90 that extends through the lever arm 84 in a direction perpendicular to the longitudinal axis of the lever arm. The hollow 86 may be configured and adapted to receive a compression spring 66A (FIG. 3A).

Figure 18:
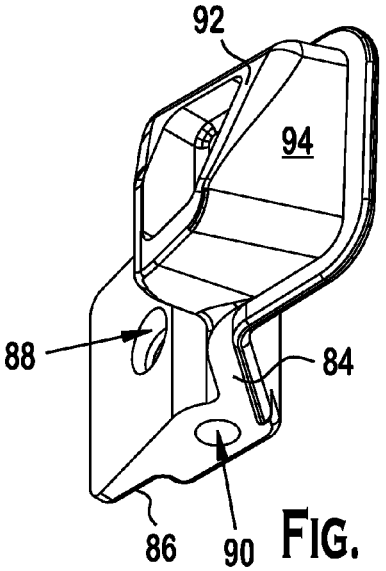
FIG. 18 is yet another perspective view of the active catch of FIG. 11.
Figure 19:
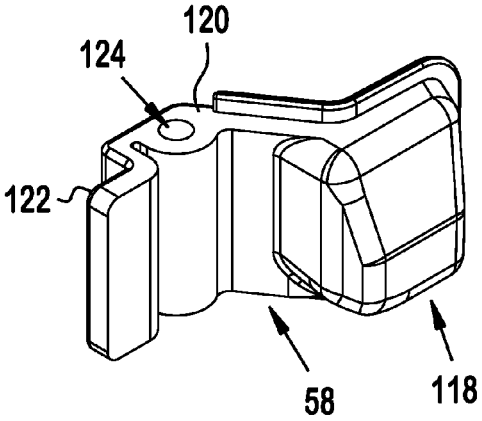
FIG. 19 is a perspective view of an exemplary embodiment of a passive catch of FIG. 2A.
Figure 20:
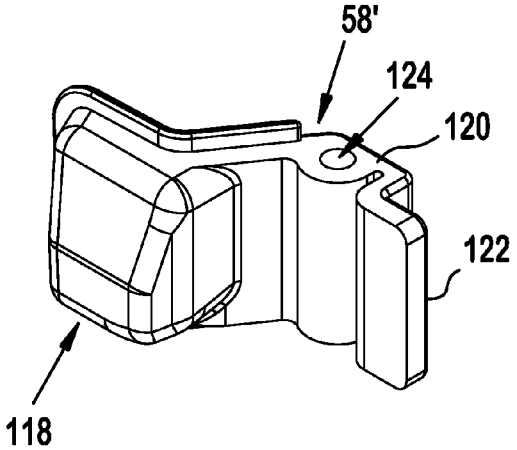
FIG. 20 is a perspective view of an exemplary embodiment of a passive catch of FIG. 2B.
Figure 21:
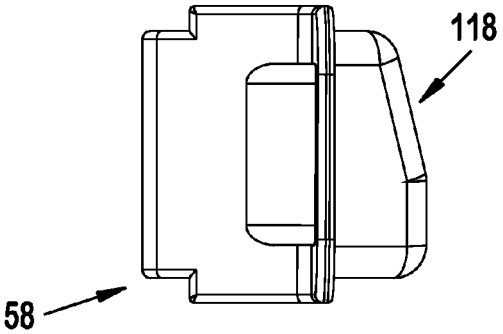
FIG. 21 is an end view of the passive catch of FIG. 19.
Figure 22:
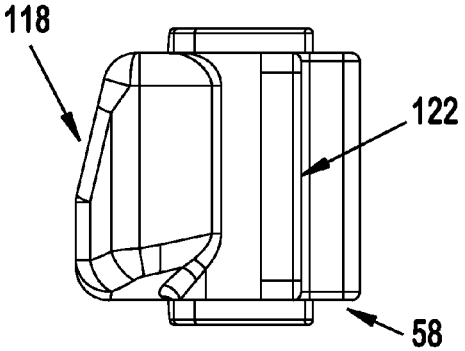
FIG. 22 is an opposite end view of the passive catch of FIG. 19.
Figure 23:
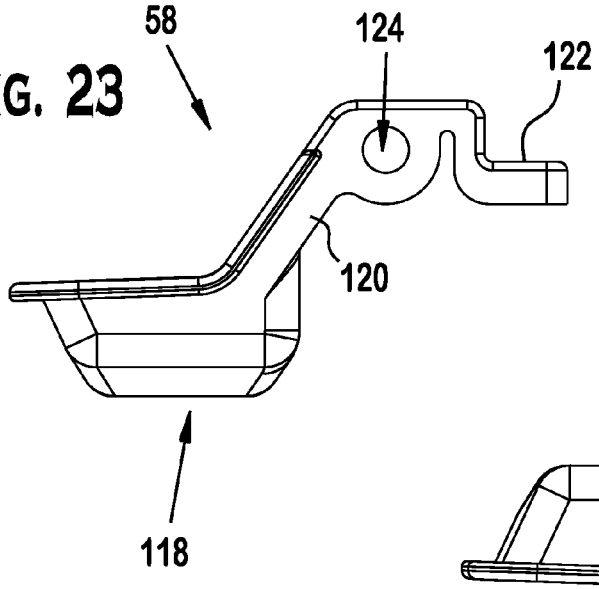
FIG. 23 is a side view of the passive catch of FIG. 19.
Figure 24:
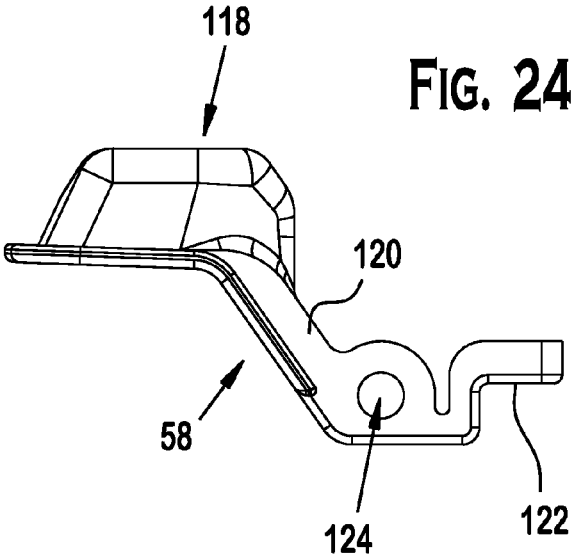
FIG. 24 is an opposite side view of the passive catch of FIG. 19.
Figure 25:
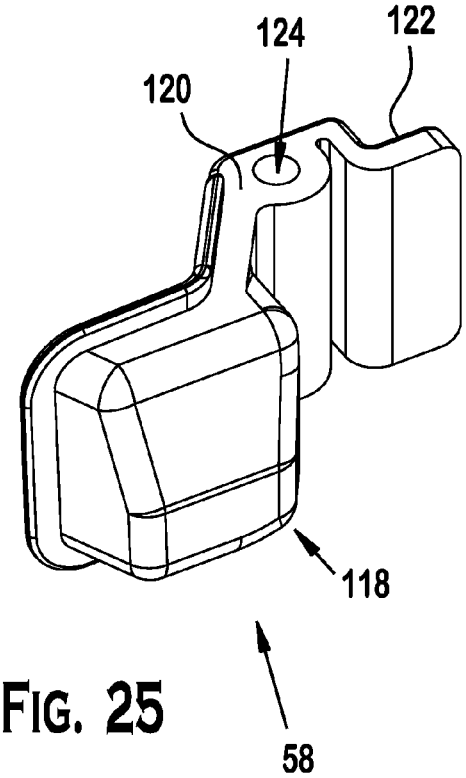
FIG. 25 is another perspective view of the passive catch of FIG. 19.

Referring to FIG. 18, the locking member 82 may include a tapered sliding surface 92 and a generally flat locking face 94 adjacent the tapered sliding surface. The tapered sliding surface 92 may be configured to allow the front trigger guard of a handgun to slide against the tapered surface when the handgun is inserted into the receptacle. By contrast, the locking face 92 may be configured to block rearward movement of the trigger guard after the handgun has been holstered. FIG. 9 depicts the locking member 82 engaged with the trigger guard 40 of a holstered handgun.

Referring to FIG. 3A and FIG. 8, the panel 50 may be a generally rectangular shaped wedge. The base 96 of the panel 50 may include a rod 98. The rod 98 may project beyond one short side of the generally rectangular panel. The tip 100 of the panel 50 may include plates 102 of reduced thickness that extend beyond the other short side of the panel. As shown in FIG. 3A, the panel 50 further may include a front surface 104 that includes a depression 52. The depression may have variable depth. The depth of the depression 106 may increase toward the tip of the panel. A portion of the depression may include ribs 54.

Referring to FIG. 8, the reverse side 106 of the panel 50 may include a central ridge 108 that divides the reverse side of the panel into a pair of side pockets 110. Each side pocket 110 may open to a long side of the panel. The reverse side 106 further may include an orifice 112 for receiving one end of a compression spring 66. The base of the orifice 112 may include a stem 114 for seating a compression spring 66. Also, the reverse side 106 of the panel may include a notch 116. The notch 116 may be disposed between the orifice 112 and the base 96 of the panel.

Referring to FIG. 3A, the active catch 46 may be configured and dimensioned to mate with the peripheral ridge segments 62 and the catch opening 80. For instance, the cross-bore 90 may be aligned between a pair of pin holes 76, and the active catch 46 may be secured to housing by inserting the rigid shaft 78 into the pin holes and cross-bore. Additionally, the hollow 86 may receive one end of a compression spring 66A and the shallow recess 64 may receive the opposite end of the compression spring 66A.

Figure 30:
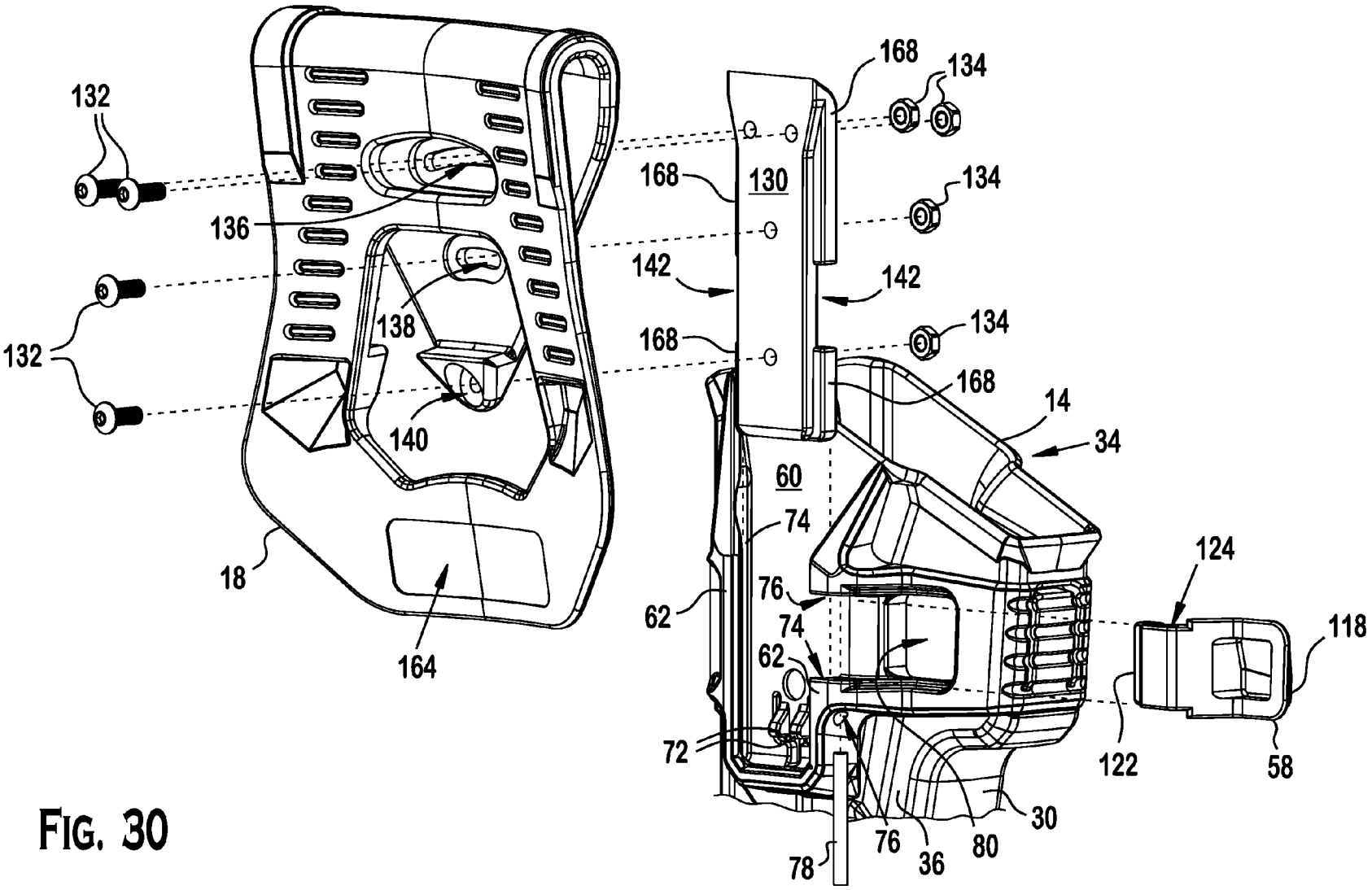
FIG. 30 is an exploded view of the port side components of the holster of FIG. 27.

As shown in FIG. 30, the port side 36 of the holster body 14 may include the same features as the starboard side 34 of the holster body 14. Thus, in a preferred embodiment, the port side 36 of the holster body 14 may be a symmetrical complement of the starboard side 34 of the holster body. Accordingly, the catch opening 80 on each respective side of the holster body 14 may receive an active catch 46, 46', a passive catch 58, 58', a blind flange 118 (FIG. 35), or other fitting.

Referring to FIGS. 19-26, the passive catch 58 may have a longitudinal axis and may include a blocking member 118 on one end of a lever arm 120, a stepped seat 122 at the opposite end of the lever arm, and a cross-bore 124 extending through the lever arm 120.

Figure 26:
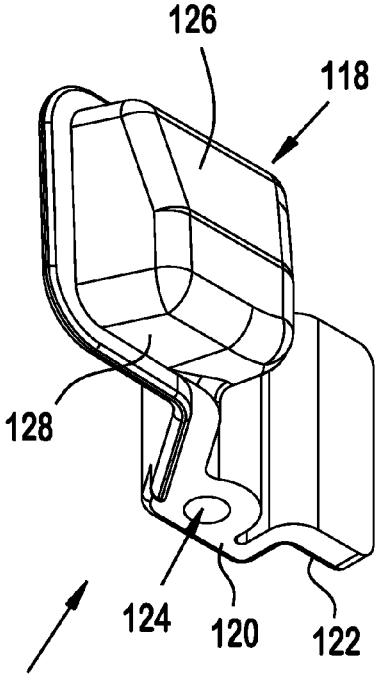
FIG. 26 is yet another perspective view of the passive catch of FIG. 19.

As best shown in FIG. 26, the blocking member 118 may include a tapered sliding surface 126 and a generally flat blocking face 128 adjacent the tapered sliding surface. The tapered sliding surface 126 may be configured to allow the front trigger guard of a handgun to slide against the tapered surface when the handgun is inserted into the receptacle. By contrast, the blocking face 128 may be configured to obstruct rearward movement of the trigger guard after the handgun has been holstered. FIG. 10 depicts the blocking member 118 engaged with the trigger guard 40 of a holstered handgun.

The passive catch may be made from a polymer having resilient properties such that the lever arm may flex outward when pushed outward by a passing trigger guard, but quickly return to its initial position in the catch opening after the trigger guard has passed. Preferably, the lever arm and blocking member quickly spring back into the catch opening after a handgun has been fully seated in the housing. More preferably, the passive catch generates a clear, audible and distinctive sound (e.g., a crack or snap) when the passive catch clears the trigger guard and springs back to a blocking position.

Referring to FIG. 3A and FIG. 30, the paddle 18 may be secured to the holster body 14 by a connector insert 130 which may be slid into the retention tracks 72 on the peripheral ridge 62 segments. The connector insert 130 may be fastened to the paddle 18 using bolts 132 and hex nuts 134 which may be received in two curved slots 136, 138 and a round hole 140 in the paddle. The curved slots 136, 138 allow adjustment of the pitch of the holster body 14. The passive catch 58 may be secured to the holster body 14 by placing the stepped seat 122 into a side pocket 142 of the connector insert 130, positioning the blocking member 118 in the catch opening 80, aligning the cross-bore 124 of the passive catch 58 between the opposing pin holes 76 in two peripheral ridge segments 62, and inserting a rigid shaft 78 through the pin holes 76 and cross-bore 124.

Figure 3B:
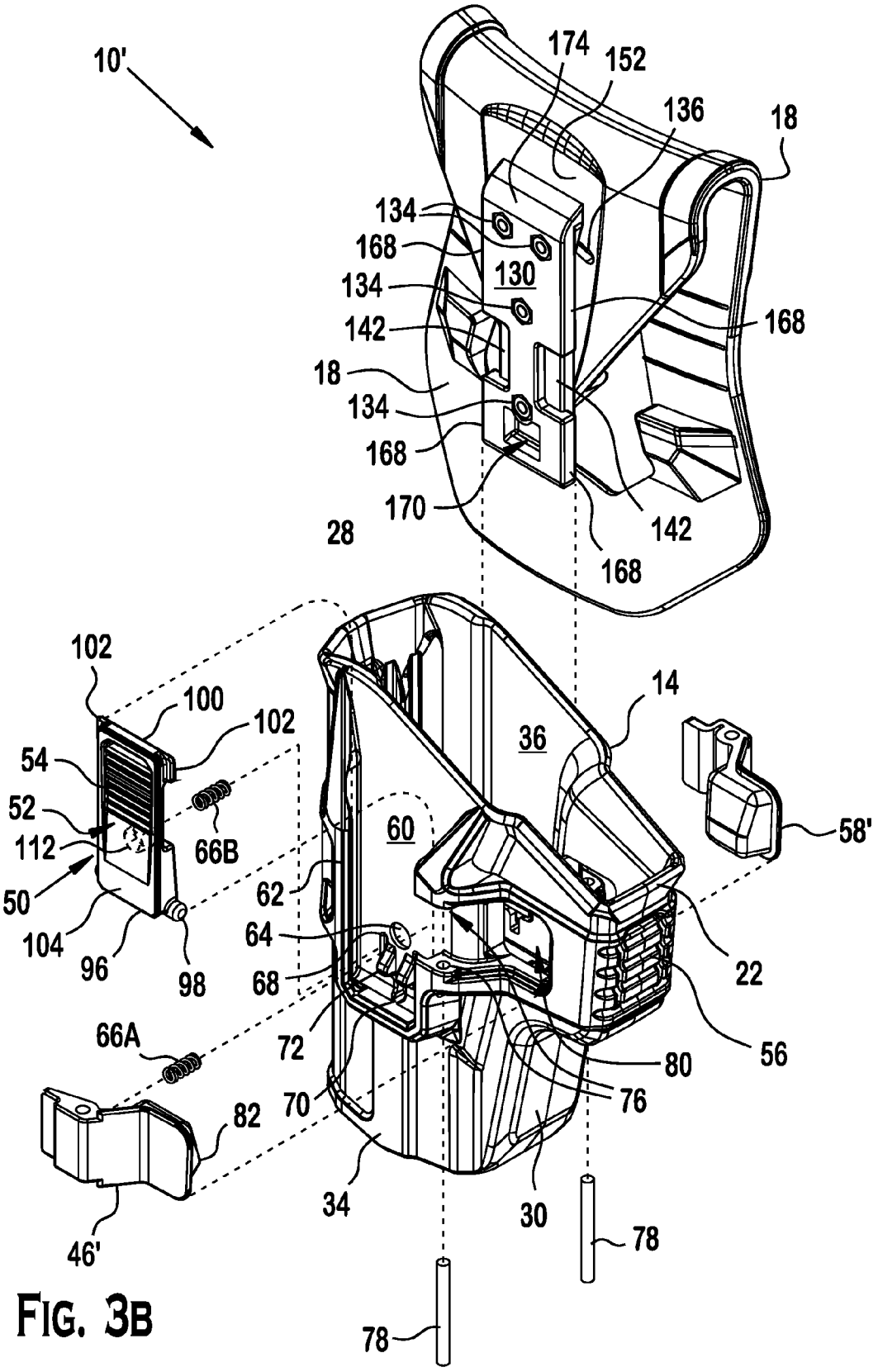
FIG. 3B is an exploded view of the holster of FIG. 2B.

FIG. 3B is an exploded view of the holster of FIG. 2B, which is configured for use by a user having a dominant left-hand. As previously described, the holster body of FIG. 3B may be the same holster body 14 as is depicted in FIG. 2A and FIG. 3A. Accordingly, the structural features and assembly of the holster of FIG. 3B may be the same as described for the holster of FIG. 3A, except that the holster 10' of FIG. 3B utilizes the active catch 46' of FIG. 12 and the passive catch 58'of FIG. 20.

Figure 4:
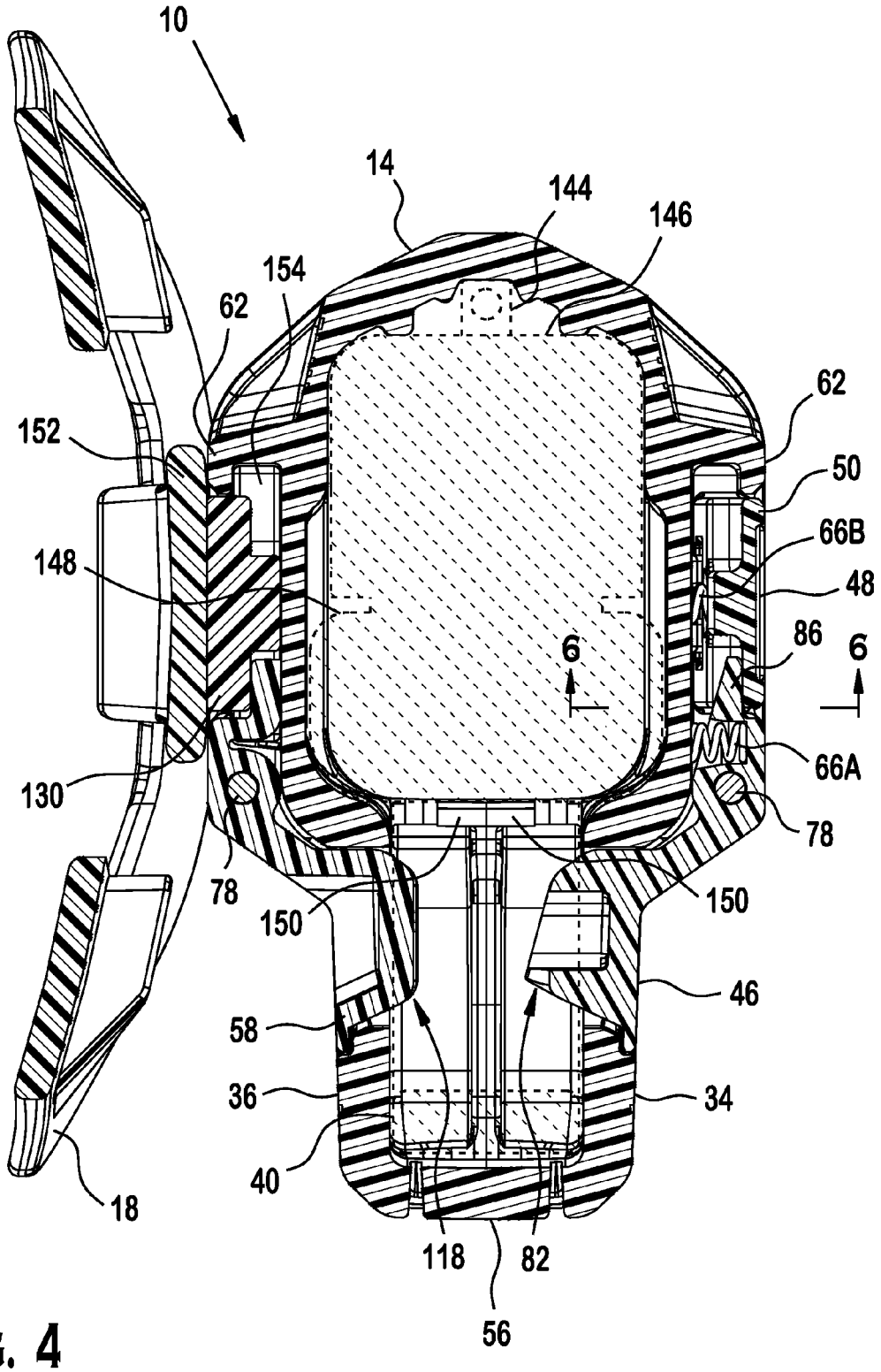
FIG. 4 is a cross-sectional view of the holster of FIG. 1, along line 4-4, where the holster is in a locked configuration.

FIG. 4 shows the holster 10 of FIG. 2A in a locked configuration. The cross-section of the holster body 14 shows the internal contour of the sidewalls of the starboard side 34 and the port side 36 of the holster body 14. A dashed outline in this area depicts a front sight 144, slide 146, frame 148, and trigger guard 40 of a holstered gun. A pair of resilient seating members 150 may be disposed under the frame 148 to support the gun. As shown in FIG. 9 and FIG. 10, the resilient seating members 150 may be configured and dimensioned to press the gun upward against the upper inner surfaces of the housing to create a tight fit with the holster and prevent rattling. The resilient seating members 150 may help the holster provide a secure fit with a handgun despite variances in the handgun dimensions.

Referring to FIG. 4, the holster 10 further may include a paddle 18, a paddle screw plate 152, and the connector insert 130. The connector insert 130 may be disposed in the recessed plane 60 on the port side 36 of the holster body 14. A projecting edge 154 of the connector insert 130 may be visible in the retention track. Further, the stepped seat 122 of the lever arm on the passive catch 58 may be received in a side pocket 142 of the connector insert. Moreover, the locking member 82 of the active catch 46 may be disposed inside the handgun trigger guard 40.

As shown in FIG. 10, the trigger guard 40 may be secured between the locking face 94 of the locking member 82 and the holster body 14 when the holster 10 is in the locked configuration. Additionally, as shown in FIG. 10, the trigger guard 40 may be secured between the blocking face 128 of the passive catch 58 and the holster body 14 when the holster 10 is in the locked configuration.

FIG. 6 shows a partial cross-sectional view of the panel 50 disposed in the retention track 74 of a peripheral ridge 62 segment. The rod 98 at the base of the panel 50 may be disposed in the retention track 74 adjacent an end wall segment 156 of the peripheral ridge 62. Generally, the base 96 of the panel may be free to rotate about the axis of the rod 98, as the rod ends may be disposed, respectively, in opposing retention tracks 74. By contrast, the locking projections 72 generally prevent the panel 50 from translating in the retention tracks 74. In this manner, the panel 50 may be pivotably connected to opposing retention tracks 74 on different segments of the peripheral ridge 62.

Still, the panel 50 may be biased away from the holster body 14 by a compression spring 66B. Projecting plates 102 near the tip 100 of the panel, however, also may be positioned in the opposing retention tracks 74 to retain the spring biased panel 50 in the retention track 74. The projecting plates 102 may be substantially thinner than the wedge shaped panel 50 in order to allow the tip 100 of the panel 50 to oscillate in the retention track 72 as the base 98 of the panel rotates in the retention track 74. Further, the stepped seat 86 of the active catch 46 may be disposed in one side pocket 110 of the panel. A compression spring 66A within the hollow 88 of the lever arm may bias the stepped seat 86 of the active catch 46 upward such that it may press against the top surface of the side pocket 110.

Figure 5:
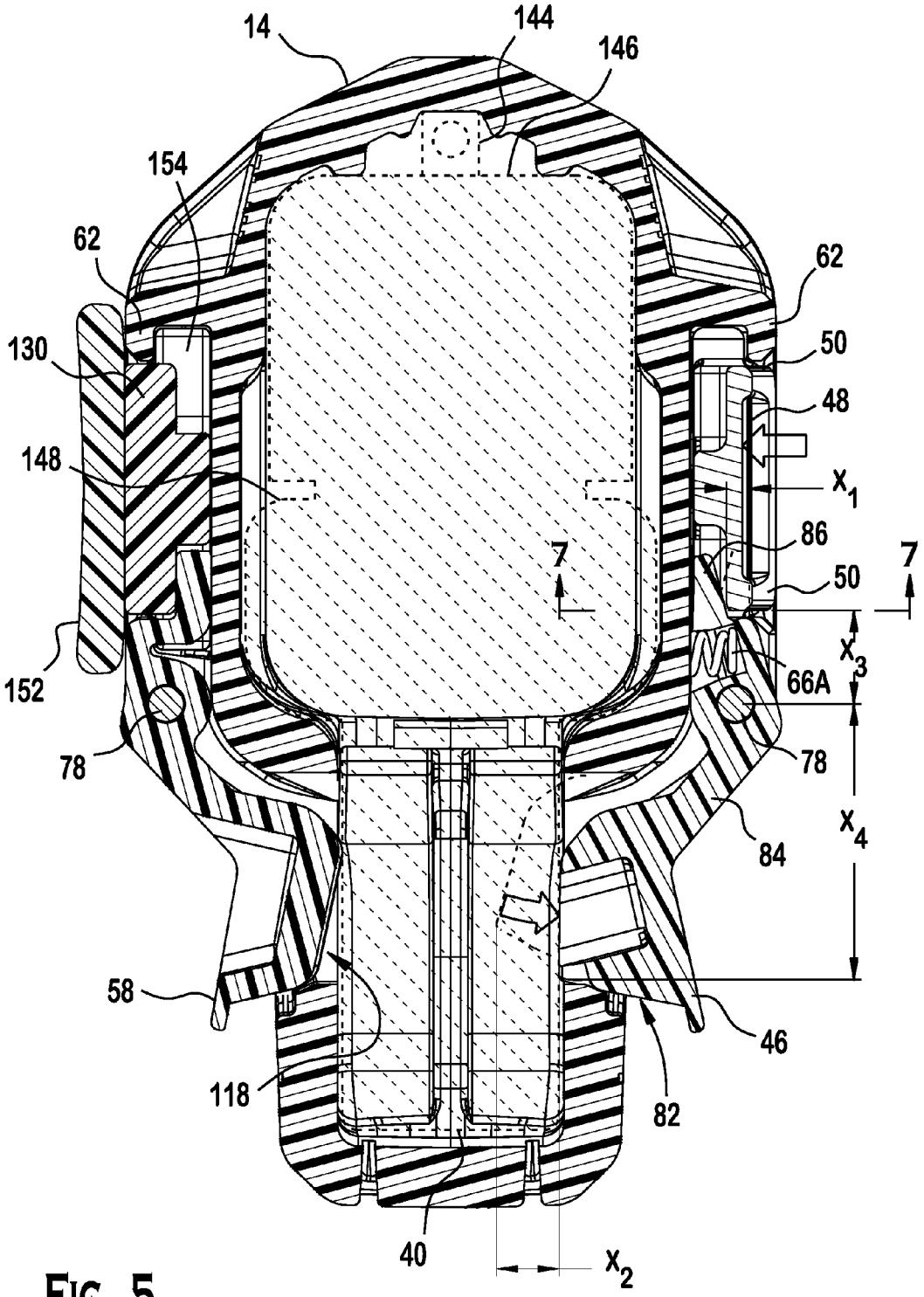
FIG. 5 is an enlarged partial view of FIG. 4, where the holster is in a released configuration.

FIG. 5 shows the holster 10 of FIG. 2A in a released configuration. The finger button 48 is depressed. The panel ridge 108 contacts the recessed plane 60, and the stepped seat 86 of the active catch 46 is pressed downward by the top surface of the side pocket 110. The lever arm 84 of the active catch 46 has pivoted about the rigid shaft 78, and the locking member 82 has been withdrawn from inside the trigger guard 40. The blocking member 118 of the passive catch 58 is pushed outward by the trigger guard 40 as the gun 12 is firmly withdrawn.

As shown in FIG. 5, the finger button panel may be displaced a distance $x_1$ to move the blocking member of the active catch a distance $x_2$. The distances from these respective points to the fulcrum of the lever arm may be identified as $x_3$ and $x_4$. In one embodiment, $x_1$ may have a value of approximately 2.5 mm, $x_2$ may have a value of approximately 5.5 mm, $x_3$ may have a value of approximately 6.3 mm, and $x_4$ may have a value of approximately 22.6 mm.

FIG. 7 shows a partial cross-sectional view of the panel 50 in a depressed position. The panel 50 is pressed to the recessed plane 60. The stepped surface 86 of the active catch is pressed down to the recessed plane by the top surface of the side pocket 110.

Figure 35:
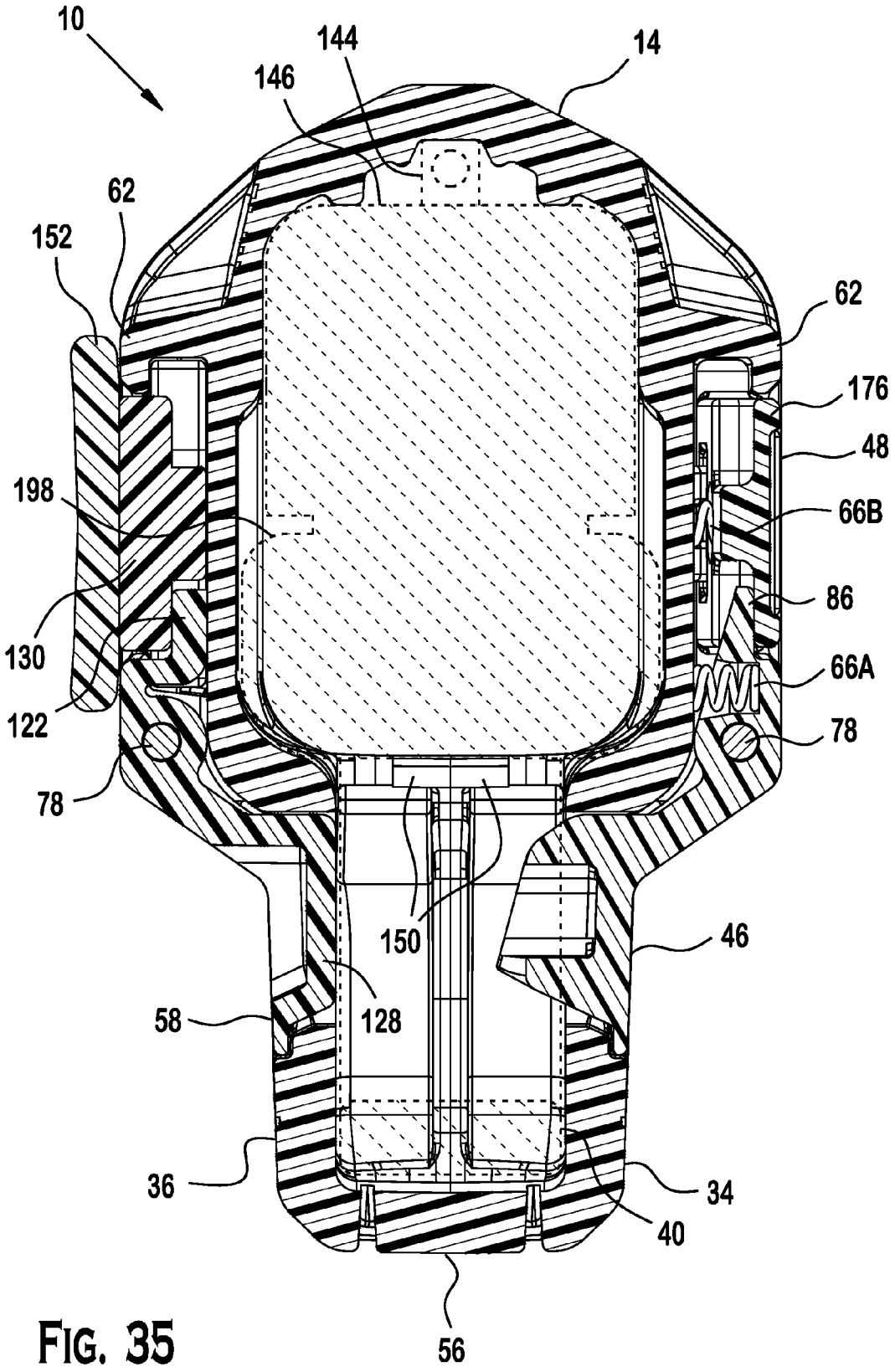
FIG. 35 is a cross-sectional view of another embodiment of the holster of FIG. 2A, along line 4-4, where the holster is in a locked configuration.

FIG. 35 shows another embodiment of the holster in the locked configuration. This embodiment is substantially the same as the embodiment described in FIG. 4 and FIG. 5, except that the blocking member 118 on the passive catch 58 has been replaced with a blind flange 128. In this embodiment, the active catch 46 is the retention mechanism.

Figure 27:
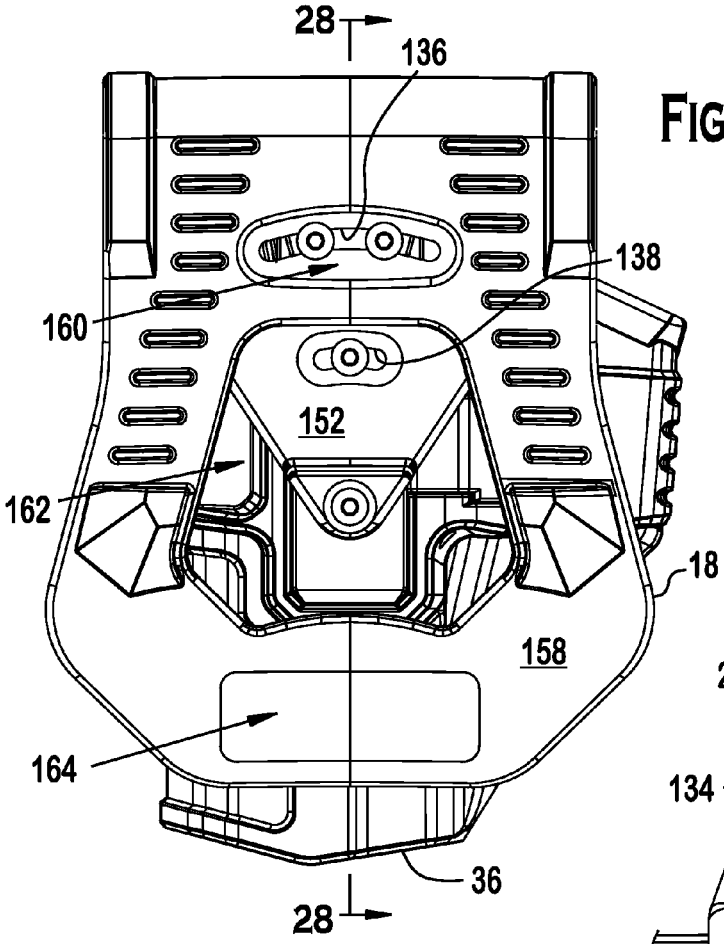
FIG. 27 is a rear view of the holster of FIG. 2A.

FIG. 27 shows a rear view of the holster of FIG. 2A. The paddle 18 may include a flat, concave shaped sheet 158 which may be configured to be worn against the body inside of a user's pants. The paddle 18 further may include an accessory attachment plate 152. The paddle may include an upper opening 160 extending from the rear side of the paddle to the front side of the paddle. The upper opening 160 may be generally oval-shaped. The upper opening 160 may provide access to the upper fastener attachment slot 136 on the accessory attachment plate 152. The paddle 18 may further include an intermediate opening 162 extending from the rear side to the front side of the paddle 18. The intermediate opening 162 may provide access to the intermediate fastener attachment slot 138 and the lower fastener attachment site 140. The paddle 18 further may include a lower opening 164 near the proximal end.

Figure 28:
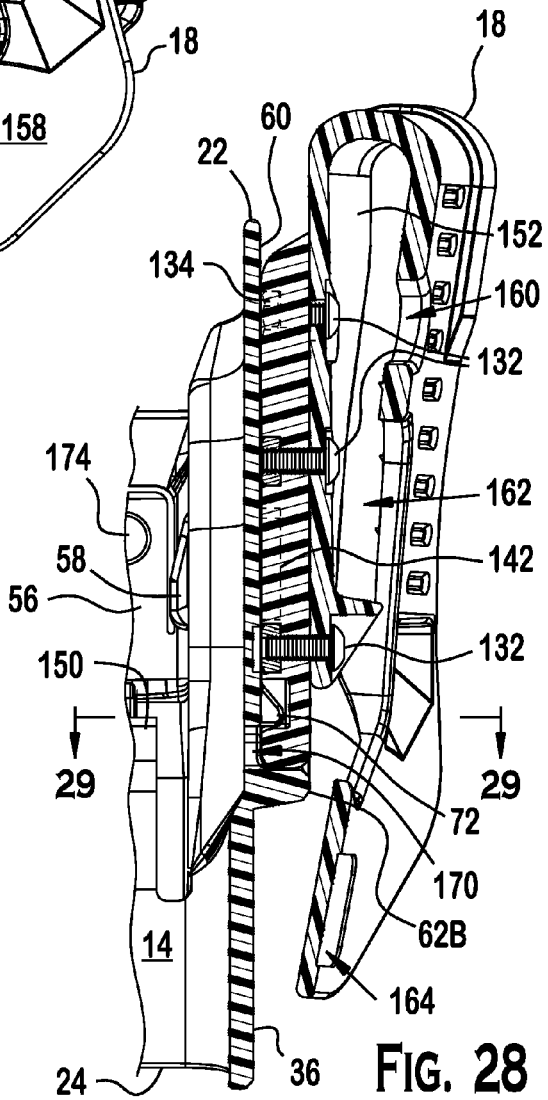
FIG. 28 is a partial cross-sectional view of the holster of FIG. 27, along line 28-28.

FIG. 28 shows an attachment mechanism for connecting the paddle 18 to the holster body 14. The attachment mechanism includes an accessory attachment plate 152 and a connector insert 130. The connector insert 130 may include a generally rectangular member 174 that includes side flanges 168, a pair of side pockets 142, and a cavity 170. The connector insert 130 may be secured to the paddle accessory attachment plate 152 using a set of threaded fasteners 132 and mating hex nuts 134. The side flanges 168 of the connector insert 130 may be secured within retention tracks 174 that are disposed in the peripheral ridges 62 of the holster body 114. The connector insert 130 may be slidably received in the retention tracks 74 at the proximal end 22 of the recessed plane 60. The connector insert 130 may then be pushed toward the distal end of the holster body 14 until the locking projections spring up into the cavity 170 to fix the connector insert in the retention tracks 74.

Figure 29:
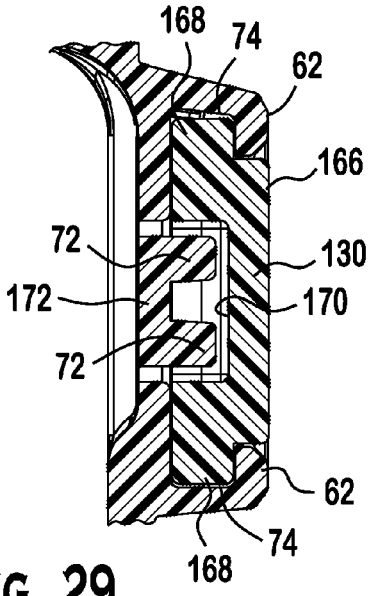
FIG. 29 is a partial cross-sectional view of the holster of FIG. 28, along line 29-29.

As shown in FIG. 29, the attachment mechanism may include a pair of retention tracks 74 and a connector insert 130 that is disposed between the retention tracks 74. The retention tracks 74 may be integrally formed within peripheral ridge 62 segments of the housing. The connector insert 130 may include an elongated member 166 with side flanges 168 which are configured and dimensioned to be slidingly received in the retention tracks 74. The side flanges 168 of the connector insert 130 interlock with the tracks 74 on the housing body 14 to block relative movement along the lateral axis of the holster body. The connector insert 130 may further include a cavity 170 between the side flanges 168. The cavity 170 may be positioned on the connector insert 130 to accommodate the locking projections 72 that extend from the recessed plane 60. The ramped shape and resilient tab 172 may allow the connector insert 130 to slide down the retention tracks 74 and over the projections 72. The pliable nature of the resilient tab 172 may allow the locking projections 72 to be displaced by the connector insert 130 toward the interior of the housing. When the cavity 170 is positioned above the locking projections 72, however, the resilient tab 172 may return to its initial position and prevent the connector insert 130 from sliding out the open end of the retention tracks 74.

In FIG. 29, the retention track 74 and flanges 168 may have a generally rectangular cross-section, however, any suitable shapes may be used for the mating surfaces provided that a secure connection between the adaptor and holster body is established. For example, the mating surfaces may be curved or form interlocking angled surfaces. In another embodiment, the locking projections and resilient tab may be located near the open end of the track such that an exterior surface of the adaptor is prevented from moving out of the tracks. In yet another embodiment, the adaptor may be pinned to the opposing tracks.

Figure 31:
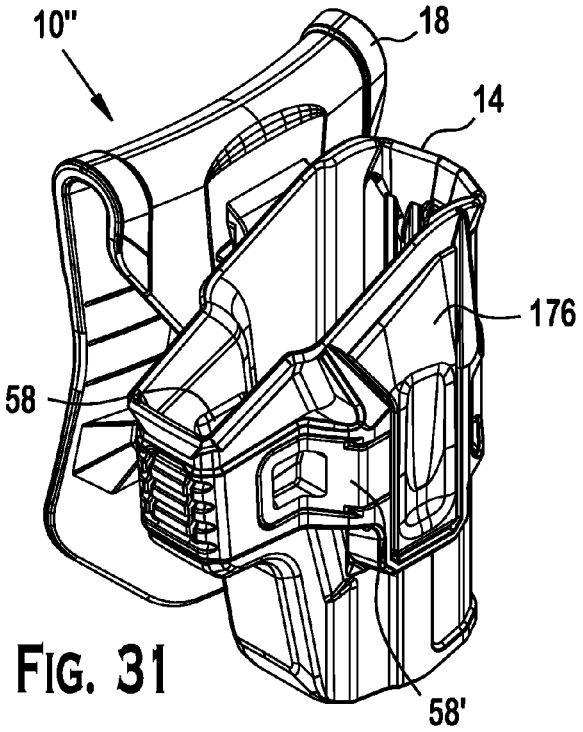
FIG. 31 is a perspective view of another embodiment of a holster for a gun in accordance with the present invention.
Figure 32:
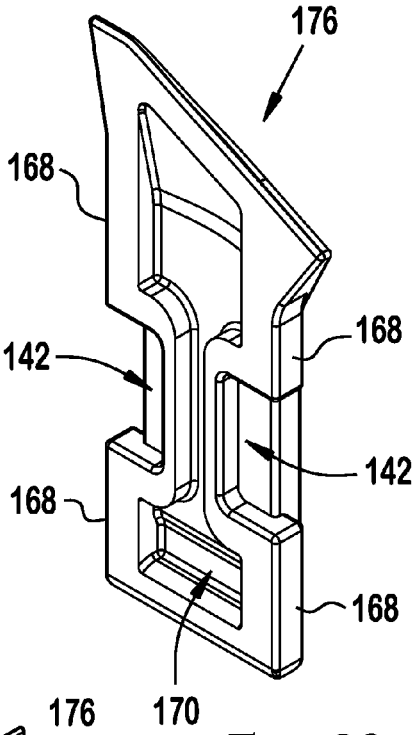
FIG. 32 is a perspective view of an exemplary embodiment of a static finger plate of FIG. 31.
Figure 33:
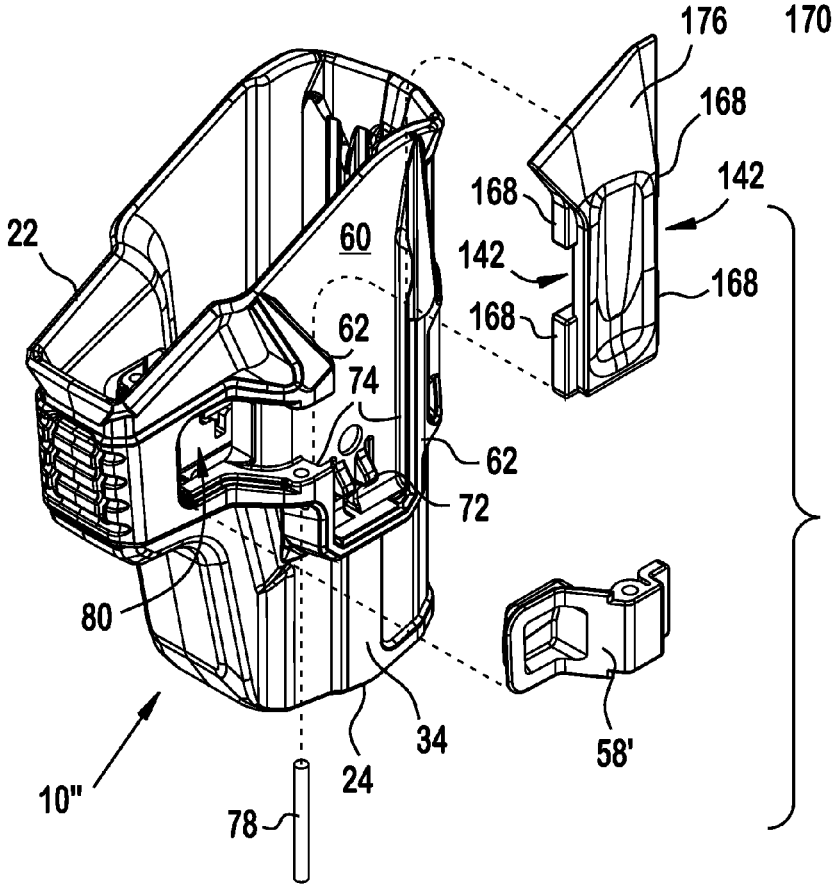
FIG. 33 is an exploded view of the starboard side of the holster body and retention assembly of FIG. 31.
Figure 34:
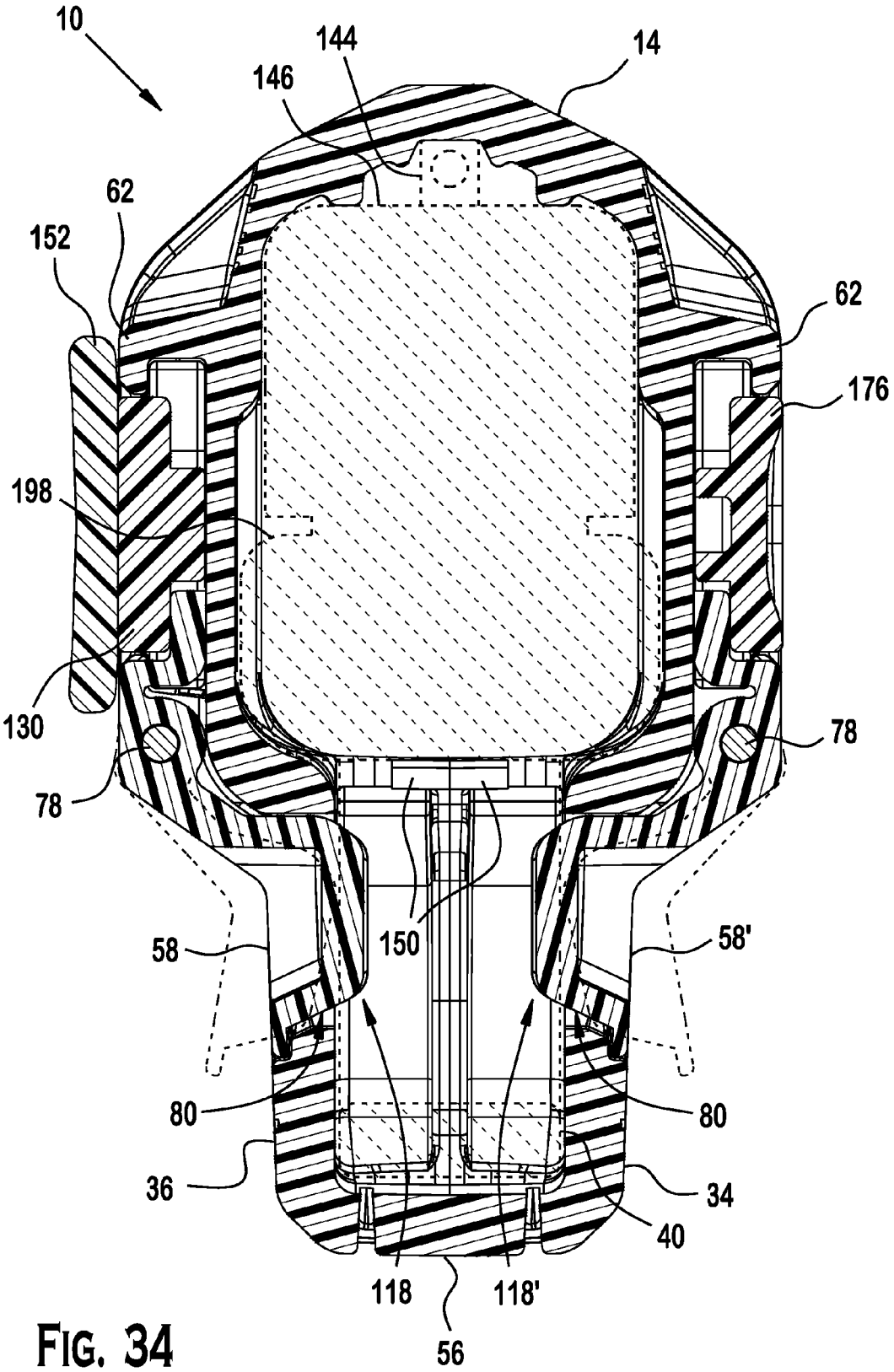
FIG. 34 is a partial cross-sectional view of the holster of FIG. 31, along line 34-34, where the holster is in a locked configuration.

FIG. 31 and FIG. 33 show another embodiment 10"of the holster of FIG. 1. In FIG. 31, the active catch and finger button panel assembly have been replaced by a second passive catch 58' and an ornamental locking insert 176. The ornamental locking insert 176 may be inserted into the retention tracks 74 on the starboard side 34 of the holster body 14. As shown in FIG. 32, the ornamental locking insert 176 may include side flanges 168, side pockets 142 and a cavity 170. These features may be similar in structure and operation to the corresponding features on the connector insert 130. Referring to FIG. 33 and FIG. 34, the ornamental locking insert 176 may be used to help position and secure the passive catch 58' in the catch opening 80 on the starboard side 34 of the holster body 14. A similar shaped device configured for the port side of the holster body may be used with a left-handed holster configuration. Additionally, a symmetrical ornamental locking insert may be used with a right-handed or left-handed holster configuration.

The holster components (other than the springs) may be formed from a polymer material. For example, the housing may be formed from an injection molded polymer (e.g., polyamide, polyphthalamide (PPA), or poly aryl ether ketone (PEK)). Additionally, the polymer matrix may include reinforcement fibers (e.g., carbon-fiber or glass-fiber). Although polymer or reinforced polymer materials may be preferred for forming the holster, other materials that are sufficiently strong and durable may be used. Also, selected holster components may be formed from carbon-fiber reinforced polymer. For example, the active catch may be formed from a carbon-fiber reinforced polymer material to create a strong and stiff component. In another example, one or more passive catch components may be formed with differing compositions or formulations of carbon-fiber reinforced polymer to provide a set of passive catches having different degrees of strength and resilience. In this fashion, the force required to overcome the holster's passive catch (or "pull force") may be selected or customized by or for a user.

In use, a gun with a trigger guard may be inserted into the holster body receptacle until the gun is fully seated. As the trigger guard passes a blocking member inside the holster body receptacle, the blocking member may be pushed out from the receptacle to allow the trigger guard to enter deeper into the receptacle. After the trigger guard has passed the blocking member, the blocking member may return to its initial position in the receptacle. An audible sound may be generated by the one or more catches as they snap or return to their initial position in the receptacle. The blocking member may be situated in a locked configuration based on its position inside the trigger guard, which may prevent the gun from moving back out of the receptacle. An active catch may be released from the locked configuration by withdrawing the blocking member from the trigger guard. An active catch may be released from the trigger guard by pressing the finger button. A passive catch may be released from a locked configuration by making a sharp, strong pull of the gun, upward from the holster body. Either catch acting by itself may provide a Level I retention holster. In combination, the active and passive catches may provide a Level II retention holster.

The structure of the holster body and the other operable components described above allow for a single holster body to be used to provide a wide spectrum of holster configuration. For example, the holster body may be assembled into a Level II retention holster that is configured for a user with a dominant right hand. In another example, the holster body may be assembled into a Level II retention holster that is configured for a user with a dominant left hand. In yet another example, the holster body may be assembled into a Level I retention holster using one passive catch for a user with a right dominant hand. In yet another example, the holster body may be assembled into a Level I retention holster using one passive catch for a user with a left dominant hand. Similarly, the holster body may be assembled into a Level I retention holster using one active catch for a user with a left dominant hand. In yet another example, the holster body may be assembled into a Level I retention holster using one active catch for a user with a right dominant hand. In yet another example, the holster body may be assembled into a Level I retention holster using two passive catches for a user with a left dominant hand. In yet another example, the holster body may be assembled into a Level I retention holster using two passive catches for a user with a right dominant hand. Moreover, the strength and resilience of the passive catch may be varied to provide further customization of the product.

Further additional accessories may be configured for use with the holster body. For example, a belt loop with a connector insert may be used instead of the paddle as another method of carrying the holster body.

While it has been illustrated and described what at present are considered to be a preferred embodiment of the present invention, it will be understood by those skilled in the art that various changes and modifications may be made, and equivalents may be substituted for elements thereof without departing from the true scope of the invention. For example, the holster body may be used with other accessories, such as a universal joint in order to allow the position of the holster body to be rotated about all three coordinate axes. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A holster for a gun comprising:

a holster body having a longitudinal axis, a vertical axis, and a lateral axis, which comprises a proximal end portion and a distal end portion spaced from the proximal end portion along the longitudinal axis, a port sidewall and a starboard sidewall spaced from the port sidewall along the lateral axis, an upper sidewall and a lower sidewall spaced from the upper sidewall along the vertical axis, and a receptacle for a gun having a trigger guard, the receptacle being situated between the port sidewall, the starboard sidewall, the upper sidewall and the lower sidewall, which comprises a rim about the proximal end portion for accessing the receptacle, a barrel receiving portion adjacent the upper sidewall, a trigger guard receiving portion adjacent the lower sidewall, a first catch opening adjacent the trigger guard portion, the first catch opening extending through the starboard sidewall, a first catch attachment site situated near the first catch opening, and a first finger button panel attachment site spaced from the first catch attachment site;

a first catch connected to the first catch attachment site, the first catch comprising a first blocking member, a first lever end, and a first holster body attachment site disposed between the first blocking member and the first lever end such that the first holster body attachment site is attached to the first catch attachment site to form a first catch pivot axis;

a first finger button panel, which is connected to the first finger button panel attachment site, and which comprises a tip portion which comprises a first plate, a base portion, a first side pocket which is situated between the tip portion and the base portion such that the first lever end of the first catch is positioned in the first side pocket, and a first holster body connection site located near the base portion such that the first holster body connection site is secured to the first finger button panel attachment site to form a first finger button panel pivot axis, and the first catch pivot axis is substantially parallel to the longitudinal axis of the holster body, and the first finger button pivot axis is substantially parallel to the vertical axis of the holster body.

2. The holster of claim 1, wherein the holster further comprises a fastener and the fastener connects the first holster body attachment site to the first catch attachment site.

3. The holster of claim 2, wherein the fastener is a rigid pin.

4. The holster of claim 1, wherein the first finger button attachment site comprises a first retention track segment adjacent the starboard sidewall of the holster body and the first plate of the first finger button panel is disposed in the first retention track segment.

5. The holster of claim 4, wherein the tip portion further comprises a second plate, the first finger button attachment site comprises a second retention track segment facing the first retention track segment, and the second plate is disposed in the second retention track segment.

6. The holster of claim 1, wherein the holster body is symmetrical about a central plane defined by the longitudinal axis and the vertical axis of the holster body.

7. The holster of claim 1, wherein the first lever end is interposed between the first finger button panel and the holster body.

8. The holster of claim 7, wherein the first side pocket fixes the first lever end with respect to the holster body.

9. The holster of claim 1, wherein the holster comprises a first configuration and a second configuration such that in the first configuration the first blocking member is positioned inside the trigger guard receiving portion of the receptacle to obstruct passage of a holstered gun's trigger guard, and in the second configuration the first catch is positioned to allow passage of a holstered gun's trigger guard.

10. The holster of claim 9, wherein the holster further comprises:

an accessory connector insert which comprises a core, a side flange, and a second side pocket intersecting the side flange; and wherein the holster body further comprises a second catch opening adjacent the trigger guard portion, the second catch opening extending through the port sidewall, a second catch attachment site situated near the second catch opening; and a second finger button panel attachment site spaced from the second catch attachment site, such that the side flange interlocks with the second finger button panel attachment site to secure the holster body to the accessory connector insert.

11. The holster of claim 10, wherein the holster further comprises:

a second catch connected to the second catch attachment site which comprises a second blocking member, a second lever end, and a second holster body attachment site disposed between the second blocking member and the second lever end such that the second holster body attachment site is attached to the second catch attachment site to form a second catch pivot axis; and a second fastener, the second fastener connecting the second holster body attachment site to the second catch attachment site;

wherein the second lever end is interposed between the accessory connector insert and the holster body, and the second side pocket fixes the second lever end to the holster body.

12. The holster of claim 11, wherein in the second configuration the first catch flexes outwardly from the trigger guard receiving portion of the receptacle to allow passage of a holstered gun's trigger guard in response to application of a first preset level of force by a holstered gun's trigger guard against the first blocking member, and wherein the holster further comprises a third configuration and a fourth configuration such that in the third configuration the second blocking member is positioned inside the trigger guard receiving portion of the receptacle to obstruct passage of a holstered gun's trigger guard, and in the fourth configuration the second catch flexes outwardly from the trigger guard receiving portion of the receptacle to allow passage of a holstered gun's trigger guard in response to application of a second preset level of force by a holstered gun's trigger guard against the second blocking member.

13. The holster of claim 12, wherein the second preset level of force is approximately equal to the first preset level of force.

14. The holster of claim 10, wherein the accessory connector insert is connected to a paddle.

15. The holster of claim 1, wherein the holster further comprises a fifth configuration and a sixth configuration such that in the fifth configuration the first blocking member is positioned inside the trigger guard receiving portion of the receptacle to obstruct passage of a holstered gun's trigger guard, and in the sixth configuration the first catch is pivoted outwardly from the trigger guard receiving portion of the receptacle to allow passage of a holstered gun's trigger guard in response to application of a third preset level of force by the first finger button panel against the first lever end.

16. The holster of claim 15, wherein the finger button panel is spaced from the holster body in the fifth configuration and the finger button panel contacts the holster body in the sixth configuration.

17. The holster of claim 16, wherein the holster further comprises:

a first resilient member positioned between the first catch and the holster body, and a second resilient member positioned between the finger button panel and the holster body, wherein the first and second resilient members bias the holster into the fifth configuration.

18. The holster of claim 1, wherein the holster further comprises:

an accessory connector insert which comprises a core, a side flange, and a second side pocket intersecting the side flange; and wherein the holster body further comprises a second catch opening adjacent the trigger guard portion, the second catch opening extending through the port sidewall, a second catch attachment site situated near the second catch opening; and a second finger button panel attachment site spaced from the second catch attachment site, such that the side flange interlocks with the second finger button panel attachment site to secure the holster body to the accessory connector insert.

19. The holster of claim 18, wherein the holster further comprises:

a second catch connected to the second catch attachment site which comprises a second blocking member, a second lever end, and a second holster body attachment site disposed between the second blocking member and the second lever end such that the second holster body attachment site is attached to the second catch attachment site to form a second catch pivot axis; and a second fastener, the second fastener connecting the second holster body attachment site to the second catch attachment site;

wherein the second lever end is interposed between the accessory connector insert and the holster body, and the second side pocket fixes the second lever end to the holster body.

20. The holster of claim 19, wherein the holster further comprises a seventh configuration and an eighth configuration such that in the seventh configuration the first and second blocking members are positioned inside the trigger guard receiving portion of the receptacle to obstruct passage of a holstered gun's trigger guard, and in the eighth configuration the first catch is pivoted outwardly from the trigger guard receiving portion of the receptacle to allow passage of a holstered gun's trigger guard in response to application of a fourth preset level of force by the finger button panel against the first lever end and the second catch flexes outwardly from the trigger guard receiving portion of the receptacle to allow passage of a holstered gun's trigger guard in response to application of a fifth preset level of force by a holstered gun's trigger guard against the second blocking member.

21. The holster of claim 1, wherein the starboard sidewall comprises an exterior surface, and the first finger button panel attachment site is located on the exterior surface.

22. A holster for a gun comprising:

a holster body having a longitudinal axis, a vertical axis, and a lateral axis, which comprises a proximal end portion and a distal end portion spaced from the proximal end portion along the longitudinal axis, a port sidewall and a starboard sidewall spaced from the port sidewall along the lateral axis, an upper sidewall and a lower sidewall spaced from the upper sidewall along the vertical axis, and a receptacle for a gun having a trigger guard, the receptacle being situated between the port sidewall, the starboard sidewall, the upper sidewall and the lower sidewall, which comprises a rim about the proximal end portion for accessing the receptacle, a barrel receiving portion adjacent the upper sidewall, a trigger guard receiving portion adjacent the lower sidewall, a first catch opening adjacent the trigger guard portion, the first catch opening extending through the starboard sidewall, a first catch attachment site situated near the first catch opening, and a first finger button panel attachment site spaced from the first catch attachment site;

a first catch connected to the first catch attachment site, the first catch comprising a first blocking member, a first lever end, and a first holster body attachment site disposed between the first blocking member and the first lever end such that the first holster body attachment site is attached to the first catch attachment site to form a first catch pivot axis;

a first finger button panel, which is connected to the first finger button panel attachment site, and which comprises a tip portion which comprises a first plate, a base portion, a first side pocket which is situated between the tip portion and the base portion such that the first lever end of the first catch is positioned in the first side pocket;

a first resilient member positioned between the first catch and the holster body; and a second resilient member positioned between the finger button panel and the holster body, wherein the holster further comprises a fifth configuration and a sixth configuration such that in the fifth configuration the first blocking member is positioned inside the trigger guard receiving portion of the receptacle to obstruct passage of a holstered gun's trigger guard, and in the sixth configuration the first catch is pivoted outwardly from the trigger guard receiving portion of the receptacle to allow passage of a holstered gun's trigger guard in response to application of a third preset level of force by the first finger button panel against the first lever end, and wherein the first finger button panel is spaced from the holster body in the fifth configuration, the finger button panel contacts the holster body in the sixth configuration, and the first and second resilient members bias the holster into the fifth configuration.

23. The holster of claim 22, wherein the holster further comprises:

an accessory connector insert which comprises a core, a side flange, and a second side pocket intersecting the side flange; and wherein the holster body further comprises a second catch opening adjacent the trigger guard portion, the second catch opening extending through the port sidewall, a second catch attachment site situated near the second catch opening; and a second finger button panel attachment site spaced from the second catch attachment site, such that the side flange interlocks with the second finger button panel attachment site to secure the holster body to the accessory connector insert.

24. The holster of claim 23, wherein the holster further comprises:

a second catch connected to the second catch attachment site which comprises a second blocking member, a second lever end, and a second holster body attachment site disposed between the second blocking member and the second lever end such that the second holster body attachment site is attached to the second catch attachment site to form a second catch pivot axis; and a second fastener, the second fastener connecting the second holster body attachment site to the second catch attachment site;

wherein the second lever end is interposed between the accessory connector insert and the holster body, and the second side pocket fixes the second lever end to the holster body.

25. The holster of claim 24, wherein the holster further comprises a seventh configuration and an eighth configuration such that in the seventh configuration the first and second blocking members are positioned inside the trigger guard receiving portion of the receptacle to obstruct passage of a holstered gun's trigger guard, and in the eighth configuration the first catch is pivoted outwardly from the trigger guard receiving portion of the receptacle to allow passage of a holstered gun's trigger guard in response to application of a fourth preset level of force by the finger button panel against the first lever end and the second catch flexes outwardly from the trigger guard receiving portion of the receptacle to allow passage of a holstered gun's trigger guard in response to application of a fifth preset level of force by a holstered gun's trigger guard against the second blocking member.

* * * * *